US010888988B2

(12) United States Patent
Zhong et al.

(10) Patent No.: US 10,888,988 B2
(45) Date of Patent: Jan. 12, 2021

(54) POWER TOOL

(71) Applicant: Positec Power Tools (Suzhou) Co., Ltd, Suzhou (CN)

(72) Inventors: Hongfeng Zhong, Suzhou (CN); Xiaoli Pang, Suzhou (CN); Yu Wu, Suzhou (CN); Jingtao Xu, Suzhou (CN); Yichun Ma, Suzhou (CN)

(73) Assignee: Positec Power Tools (Suzhou) Co., Ltd, Suzhou (CN)

( * ) Notice: Subject to any disclaimer, the term of this patent is extended or adjusted under 35 U.S.C. 154(b) by 489 days.

(21) Appl. No.: 15/550,607

(22) PCT Filed: Feb. 5, 2016

(86) PCT No.: PCT/CN2016/073681
§ 371 (c)(1),
(2) Date: Aug. 11, 2017

(87) PCT Pub. No.: WO2016/127930
PCT Pub. Date: Aug. 18, 2016

(65) Prior Publication Data

US 2018/0029215 A1 Feb. 1, 2018

(30) Foreign Application Priority Data

Feb. 15, 2015 (CN) ..... 2015 2 0111606 U
Aug. 19, 2015 (CN) ..... 2015 1 0511333
Nov. 16, 2015 (CN) ..... 2015 1 0779992

(51) Int. Cl.
*B25F 5/00* (2006.01)
*B25F 5/02* (2006.01)

(52) U.S. Cl.
CPC ..... *B25F 5/006* (2013.01); *B25F 5/02* (2013.01)

(58) Field of Classification Search
CPC ..... B25F 5/006; B25F 5/02; B25D 17/043; B25D 17/24; B25D 2217/0073
See application file for complete search history.

(56) References Cited

U.S. PATENT DOCUMENTS 4,936,394 A * 6/1990 Ohtsu ..... B24B 23/005 173/162.2
5,027,910 A * 7/1991 Honsa ..... B25D 17/24 173/162.1

(Continued)

FOREIGN PATENT DOCUMENTS

CN 101088712 A 12/2007
CN 103372856 A 10/2013

(Continued)

OTHER PUBLICATIONS

International Search Report from International Application No. PCT/CN2016/073681, dated May 5, 2016, 6 pages with English translation.

(Continued)

*Primary Examiner* — Thomas M Wittenschlaeger
(74) *Attorney, Agent, or Firm* — TraskBritt

(57) ABSTRACT

This disclosure describes a power tool comprising a housing, a motor received in the housing and an output shaft driven by the motor and used for mounting a cutting tool. The housing comprises a first head housing and a second head housing. The first head housing is used for receiving part of the output shaft. A maximal length of the first head housing along an axial direction of the output shaft is L. A plane where the axis of the output shaft is positioned is defined as a middle plane. N vibration damping elements are disposed between the first head housing and the second head housing and, on at least one side of the middle plane, each vibration damping element comprises a vibration damping part contacting with the first head housing and the second (Continued)

head housing. A sum of the lengths of the N vibration damping parts along the axial direction of the output shaft is larger than or equal to 0.2L and smaller than or equal to L. Therefore, a better vibration damping effect is achieved while working efficiency is not affected.

18 Claims, 19 Drawing Sheets

(56) References Cited

U.S. PATENT DOCUMENTS

| | | | | |
|---|---|---|---|---|
| 5,394,039 | A * | 2/1995 | Suchdev | B25D 17/24 173/162.2 |
| 5,699,865 | A * | 12/1997 | Forderer | B25F 5/006 173/162.2 |
| 6,286,610 | B1 * | 9/2001 | Berger | B25D 17/24 173/162.1 |
| 8,672,305 | B2 * | 3/2014 | Wolf | B25F 5/006 173/162.2 |
| 8,714,280 | B2 * | 5/2014 | Moreno | B25D 17/043 173/162.2 |
| 9,434,062 | B2 * | 9/2016 | Kamegai | B25D 17/24 |
| 9,545,713 | B2 * | 1/2017 | Johnson | B25F 5/006 |
| 9,641,046 | B2 * | 5/2017 | Christen | B24B 23/04 |
| 10,040,187 | B2 * | 8/2018 | Hess | B25F 5/006 |
| 2007/0246237 | A1 * | 10/2007 | Homsi | B25F 5/006 173/213 |
| 2007/0295522 | A1 | 12/2007 | Bohne et al. | |
| 2010/0068977 | A1 * | 3/2010 | Zhang | B24B 23/02 451/357 |
| 2011/0209888 | A1 * | 9/2011 | Elsworthy | B23B 31/1071 173/217 |
| 2013/0307354 | A1 * | 11/2013 | Christen | B24B 23/04 310/50 |
| 2014/0326477 | A1 * | 11/2014 | Thorson | B25F 5/006 173/171 |
| 2015/0034347 | A1 * | 2/2015 | Hess | B25F 5/006 173/162.2 |
| 2017/0008160 | A1 * | 1/2017 | Simma | B25F 5/001 |

FOREIGN PATENT DOCUMENTS

| | | | |
|---|---|---|---|
| CN | 104245238 | A | 12/2014 |
| CN | 104245239 | A | 12/2014 |
| CN | 205497391 | U | 8/2016 |
| CN | 205497392 | U | 8/2016 |
| CN | 205497395 | U | 8/2016 |
| CN | 205497401 | U | 8/2016 |
| EP | 2444206 | A1 | 4/2012 |
| JP | 2001-510099 | A | 7/2001 |
| WO | 9419152 | A1 | 9/1994 |

OTHER PUBLICATIONS

International Written Opinion from International Application No. PCT/CN2016/073681, dated May 5, 2016, 3 pages.

European Search Report and Written Opinion from European Application No. 16748731.3, dated Oct. 10, 2018, 9 pages.

Chinese Office Action and Search Report from Chinese Application No. 201510779992.7, dated Jul. 4, 2017, 16 pages.

Chinese First Office Action for Chinese Application No. 201510779375 dated Jul. 4, 2017, 12 pages with English Translation.

Chinese First Office Action for Chinese Application No. 201510779503 dated Jul. 4, 2017, 7 pages with English Translation.

Chinese First Office Action for Chinese Application No. 201510789144 dated Jul. 4, 2017, 12 pages with English Translation.

Chinese Search Report for Chinese Application No. 201510779375 dated Jun. 23, 2017, 1 pages.

Chinese Search Report for Chinese Application No. 201510779503 dated Mar. 27, 2018, 1 pages.

Chinese Search Report for Chinese Application No. 201510779992 dated Jun. 26, 2017, 1 page.

Chinese Search Report for Chinese Application No. 201510789144 dated Jun. 26, 2017, 1 page.

Chinese Search Report for Chinese Application No. 201510789144 dated Apr. 15, 2018, 2 pages.

* cited by examiner

POWER TOOL

CROSS-REFERENCE TO RELATED APPLICATIONS

This application is a national phase entry under 35 U.S.C. § 371 of International Patent Application PCT/CN2016/073681, filed Feb. 5, 2016, designating the United States of America and published as International Patent Publication WO 2016/127930 A1 on Aug. 18, 2016, which claims the benefit under Article 8 of the Patent Cooperation Treaty to Chinese Patent Application Serial Nos. 201520111606.2, filed Feb. 15, 2015, 201510511333.5 filed Aug. 19, 2015, and 201510779992.7 filed Nov. 16, 2015.

TECHNICAL FIELD

The present invention relates to a power tool.

RELATED ART

For a power tool, such as a oscillating power tool, its output shaft performs rotary oscillating movement around an axis, and after the output shaft is provided with different accessory cutting tools, multiple different operations such as sawing, cutting, polishing, scraping, and the like can be realized to adapt to different working requirements.

The common oscillating power tool on the market at present generally comprises a housing and a motor received in the housing, a motor shaft of the motor is connected to an eccentric member, and a bearing sleeves the eccentric member, such that an eccentric component is formed. When the motor shaft rotates, the eccentric component can perform eccentric rotational movement around an axis of the motor shaft. The output shaft of the oscillating power tool is disposed by being vertical to the motor shaft, a shift fork component is fixedly connected onto the output shaft, two opposite extending arms are formed on the shift fork component to surround the eccentric component, and the inner sides of the two extending arms both make tight contact with the bearing in the eccentric component, such that when the eccentric bearing performs eccentric rotation, an eccentric transmission component will drive the shift fork to generate oscillating moment in a horizontal direction, and also by means of the fixed connection between the shift fork and the output shaft, the output shaft performs rotational oscillating around its axis. In this way, after a free end of the output shaft is connected to different accessory cutting tools, such as a straight saw web, a circular saw web, a triangular dull polishing tray, etc., the oscillating power tool can realize multiple operations.

However, the oscillating power tool inevitably generates larger vibration in a working process. The motor is directly disposed on the housing, an operator often directly holds the housing during operation, as a result, the vibration is transmitted from the tool to the operator, and therefore, operation comfortableness of the oscillating power tool is affected.

Therefore, it is indeed necessary to develop a new power tool to solve the problem mentioned above.

BRIEF SUMMARY

An objective of the present invention aims to provide a power tool which can effectively reduce vibration of a holding part and improve operation comfortableness.

In order to solve the problem above, a technical solution of the present invention is that: a power tool comprises a housing, a motor received in the housing and an output shaft driven by the motor and used for mounting a cutting tool; the housing comprises a first head housing and a second head housing, the first head housing is used for receiving part of the output shaft, a maximal length of the first head housing along an axial direction of the output shaft is L, a plane where the axis of the output shaft is positioned is defined as a middle plane, N vibration damping elements are disposed between the first head housing and the second head housing and on at least one side of the middle plane, each vibration damping element comprises a vibration damping part contacting with the first head housing and the second head housing, and a sum of the lengths of the N vibration damping parts along the axial direction of the output shaft is larger than or equal to 0.2L and smaller than or equal to L.

Preferably, a sum of the lengths of the N vibration damping parts along the axial direction of the output shaft is larger than or equal to 0.4L and smaller than or equal to 0.7L.

Preferably, two vibration damping elements are disposed between the first head housing and the second head housing and on at least one side of the middle plane, and longitudinally extending directions Z1 and Z2 of two abutting members abutting against the two vibration damping elements respectively are set at an angle.

Preferably, the housing further comprises a first motor housing fixedly connected to the first head housing and a second motor housing fixedly connected to the second head housing, the first motor housing is used for mounting the motor, and a motor housing vibration damping device is disposed between the first motor housing and the second motor housing.

Preferably, on one side of the middle plane, the motor housing vibration damping device and the N vibration damping elements form at least one triangle, and the N vibration damping elements form one side of the triangle.

Preferably, one side of the triangle comprises two vibration damping elements at intervals.

Preferably, one side of the triangle comprises one longitudinally extending strip-shaped vibration damping element.

Preferably, a plane passing by the axis of the output shaft and the axis of the motor is defined as a central plane, and the plane where the triangle is and the central plane are parallel or at an angle.

Preferably, the first head housing has a first side back to the second head housing, the first side is provided with a supporting member, the second head housing is provided with a connecting unit, the connecting unit has an abutting member facing the first side and the N vibration damping elements are disposed between the supporting member and the abutting member.

Preferably, the second head housing has a first side back to the first head housing, the first side is provided with a supporting member, the first head housing is provided with a connecting unit, the connecting unit has an abutting member facing the first side and the N vibration damping elements are disposed between the supporting member and the abutting member.

In order to solve the problem above, another technical solution of the present invention is: a power tool comprises a housing, a motor received in the housing and an output shaft driven by the motor and used for mounting a cutting tool; the housing comprises a first head housing and a second head housing, the first head housing is used for receiving part of the output shaft, a plane where the axis of the output shaft is positioned is defined as a middle plane, N vibration damping elements are disposed between the first head housing and the second head housing and on at least one side of the middle plane, each vibration damping element comprises a vibration damping part contacting with the first head housing and the second head housing, and a distance between two furthest points of the N vibration damping parts along an axial direction of the output shaft is larger than the distance between the two furthest points along a radial direction of the output shaft.

In order to solve the problem above, another technical solution of the present invention is: a power tool comprises a housing, a motor received in the housing and an output shaft driven by the motor and used for mounting a cutting tool; the housing comprises a first head housing and a second head housing, the first head housing is used for receiving part of the output shaft, a maximal length of the first head housing along an axial direction of the output shaft is L, a plane where the axis of the output shaft is positioned is defined as a middle plane, N vibration damping elements are disposed between the first head housing and the second head housing and on at least one side of the middle plane, each vibration damping element comprises a vibration damping part contacting with the first head housing and the second head housing, and a distance between two furthest points of the N vibration damping parts along an axial direction of the output shaft is larger than or equal to 0.2L and smaller than or equal to L.

Compared with prior art, the N vibration damping elements are disposed in the power tool in the present invention, such that vibration generated by the movement of the output shaft is effectively prevented from being transmitted to a holding part disposed on the outer housing, the vibration of the holding part is reduced, the problem of hand numbing of a user caused by vibration in a use process is greatly improved, operation comfortableness is improved, and meanwhile, working efficiency is not affected.

In order to solve the problem above, another technical solution of the present invention is: a power tool comprises a housing, a motor received in the housing and an output shaft driven by the motor and used for mounting a cutting tool; the housing comprises a first housing and a second housing separated from the first housing by a clearance, the first housing has a first side back to the second housing, the first side is provided with a supporting member, the second housing is provided with a connecting unit, the connecting unit extends to the first side, and a vibration damping element is disposed between the connecting unit and the supporting member.

Preferably, the first housing is provided with a through hole, and the connecting unit penetrates through the through hole to extend to the first side.

Preferably, the first housing has an end surface, and the connecting unit bypasses the end surface to extend to the first side.

In order to solve the problem above, another technical solution of the present invention is: a power tool comprises a housing, a motor received in the housing and an output shaft driven by the motor and used for mounting a cutting tool; the power tool is characterized in that the housing comprises a first housing and a second housing which are intercrossed, and a vibration damping element is disposed between the first housing and the second housing.

Preferably, the first housing is provided with a connecting unit, the second housing is provided with a through hole, the connecting unit penetrates through the through hole to extend to one side of the second housing back to the first housing, and the vibration damping element is disposed between the connecting unit and the second housing.

Compared with prior art, the vibration damping element is disposed in the power tool of the present invention, such that vibration generated by the movement of the output shaft is effectively prevented from being transmitted to a holding part disposed on the outer housing, the vibration of the holding part is reduced, the problem of hand numbing of a user caused by vibration in a use process is greatly improved, and operation comfortableness is improved.

In order to solve the problem above, another technical solution of the present invention is that: a power tool comprises a housing, a motor received in the housing and an output shaft driven by the motor and used for mounting a cutting tool; the housing comprises a first head housing and a second head housing, the first head housing is used for receiving part of the output shaft, a plane where the axis of the output shaft is positioned is defined as a middle plane, and at least two vibration damping elements are disposed between the first head housing and the second head housing and on at least one side of the middle plane.

Preferably, a connecting line between central points of the at least two vibration damping elements is a linear segment, and the linear segment and an axis of the output shaft are parallel or at an angle.

Preferably, a maximal length of the first head housing along a direction of the output shaft is L, each of the at least two vibration damping elements comprises a vibration damping part contacting with the first head housing and the second head housing, and a sum of the lengths of the at least two vibration damping parts along the axial direction of the output shaft is larger than or equal to 0.2L and smaller than or equal to L.

Preferably, a sum of the lengths of the at least two vibration damping parts along the axial direction of the output shaft is larger than or equal to 0.4L and smaller than or equal to 0.6L.

Preferably, each of the at least two vibration damping elements comprises a vibration damping part contacting with the first head housing and the second head housing, and a distance between two furthest points of the at least two vibration damping parts along an axial direction of the output shaft is larger than the distance between the two furthest points along a radial direction of the output shaft.

Preferably, the housing further comprises a first motor housing fixedly connected to the first head housing and a second motor housing fixedly connected to the second head housing, the first motor housing is used for mounting the motor, and a motor housing vibration damping device is disposed between the first motor housing and the second motor housing.

Preferably, on one side of the middle plane, the motor housing vibration damping device and the at least two vibration damping elements form at least one triangle, and the at least two vibration damping elements form one side of the triangle.

Preferably, a plane passing by the axis of the output shaft and the axis of the motor is defined as a central plane, and the plane where the triangle is and the central plane are parallel or at an angle.

Preferably, the first head housing has a first side back to the second head housing, the first side is provided with a supporting member, the second head housing is provided with a connecting unit, the connecting unit has an abutting member facing the first side and the at least two vibration damping elements are disposed between the supporting member and the abutting member.

Preferably, the second head housing has a first side back to the first head housing, the first side is provided with a supporting member, the first head housing is provided with a connecting unit, the connecting unit has an abutting member facing the first side and the at least two vibration damping elements are disposed between the supporting member and the abutting member.

Compared with the prior art, the at least two vibration damping elements are disposed in the power tool in the present invention, such that vibration generated by the movement of the output shaft is effectively prevented from being transmitted to a holding part disposed on the outer housing, the vibration of the holding part is reduced, the problem of hand numbing of a user caused by vibration in a use process is greatly improved, and operation comfortableness is improved.

In order to solve the problem above, another technical solution of the present invention is that: a power tool comprises a housing, a motor received in the housing and an output shaft driven by the motor and used for mounting a cutting tool; a maximal length of the housing along an axial direction of the output shaft is L, the housing comprises a first motor housing and a second motor housing, the first motor housing is used for mounting the motor, a plane where the axis of the output shaft is positioned is defined as a middle plane, N vibration damping elements are disposed between the first motor housing and the second motor housing and on at least one side of the middle plane, each vibration damping element comprises a vibration damping part contacting with the first motor housing and the second motor housing, and a sum of the lengths of the N vibration damping parts along the axial direction of the output shaft is larger than or equal to 0.2L and smaller than or equal to L.

Preferably, a sum of the lengths of the N vibration damping parts along the axial direction of the output shaft is larger than or equal to 0.4L and smaller than or equal to 0.7L.

Preferably, a distance between the vibration damping element closest to the output shaft in the N vibration damping elements and the axis of the output shaft is larger than or equal to 110 mm.

In order to solve the problem above, another technical solution of the present invention is that: a power tool comprises a housing, a motor received in the housing and an output shaft driven by the motor and used for mounting a cutting tool; the power tool is characterized in that a maximal length of the housing along an axial direction of the output shaft is L, the housing further comprises a first motor housing and a second motor housing, the first motor housing is used for mounting the motor, a plane where the axis of the output shaft is positioned is defined as a middle plane, N vibration damping elements are disposed between the first motor housing and the second motor housing and on at least one side of the middle plane, each vibration damping element comprises a vibration damping part contacting with the first motor housing and the second motor housing, and a distance between two furthest points of the N vibration damping parts along an axial direction of the output shaft is larger than or equal to 0.2L and smaller than or equal to L.

Compared with the prior art, the vibration damping elements are disposed in the power tool in the present invention, such that vibration generated by the movement of the output shaft is effectively prevented from being transmitted to a holding part disposed on the outer housing, the vibration of the holding part is reduced, the problem of hand numbing of a user caused by vibration in a use process is greatly improved, operation comfortableness is improved, and meanwhile, working efficiency is not reduced.

In order to solve the problem above, another technical solution of the present invention is that: a power tool comprises a housing, a motor received in the housing and an output shaft driven by the motor and used for mounting a cutting tool; the housing further comprises a first motor housing and a second motor housing, the first motor housing is used for mounting the motor, a plane where the axis of the output shaft is positioned is defined as a middle plane, and at least two vibration damping elements are disposed between the first motor housing and the second motor housing and on at least one side of the middle plane.

Preferably, a connecting line between central points of the at least two vibration damping elements is a linear segment, and the linear segment and an axis of the output shaft are parallel or at an angle.

Compared with the prior art, the vibration damping elements are disposed in the power tool in the present invention, such that vibration generated by the movement of the output shaft is effectively prevented from being transmitted to a holding part disposed on the outer housing, the vibration of the holding part is reduced, the problem of hand numbing of a user caused by vibration in a use process is greatly improved, operation comfortableness is improved, and meanwhile, working efficiency is not reduced.

In order to solve the problem above, another technical solution of the present invention is that: a power tool comprises a housing, a motor received in the housing, an output shaft used for mounting a cutting tool and an eccentric transmission mechanism disposed between the motor and the output shaft; the eccentric transmission mechanism is used for converting rotational movement of the motor into oscillating movement of the output shaft around the axis per se, a oscillating angle of the output shaft is larger than or equal to 4°, the housing comprises a first housing and a second housing which are separated at intervals, and a vibration damping device is disposed between the first housing and the second housing.

Compared with the prior art, the vibration damping elements are disposed in the power tool in the present invention, such that vibration generated by the movement of the output shaft is effectively prevented from being transmitted to a holding part disposed on the outer housing, the vibration of the holding part is reduced, the problem of hand numbing of a user caused by vibration in a use process is greatly improved, operation comfortableness is improved, and meanwhile, working efficiency is not reduced.

In order to solve the problem above, another technical solution of the present invention is that: a power tool comprises a housing, a motor received in the housing and an output shaft driven by the motor and used for mounting a cutting tool; the housing comprises a first housing and a second housing which are separated at intervals, a plane where the axis of the output shaft is positioned is defined as a middle plane, N vibration damping elements are disposed between the first housing and the second housing and on at least one side of the middle plane, the N vibration damping elements are arrayed along an axial direction of the output shaft, each vibration damping element comprises a vibration damping part contacting with the first housing and the second housing, and a sum of the lengths of the N vibration damping parts along the axial direction of the output shaft is larger than or equal to 15 mm.

Preferably, a sum of the lengths of the N vibration damping parts along the axial direction of the output shaft is larger than or equal to 20 mm.

BRIEF DESCRIPTION OF THE DRAWINGS

The present invention is further explained in combination with accompanying drawings and embodiments.

DETAILED DESCRIPTION

The present invention is further explained in detail in combination with drawings and specific embodiments.

First Embodiment

FIGS. 1-6 show an oscillating power tool 100 provided by a first embodiment of the present invention.

Figure 1:
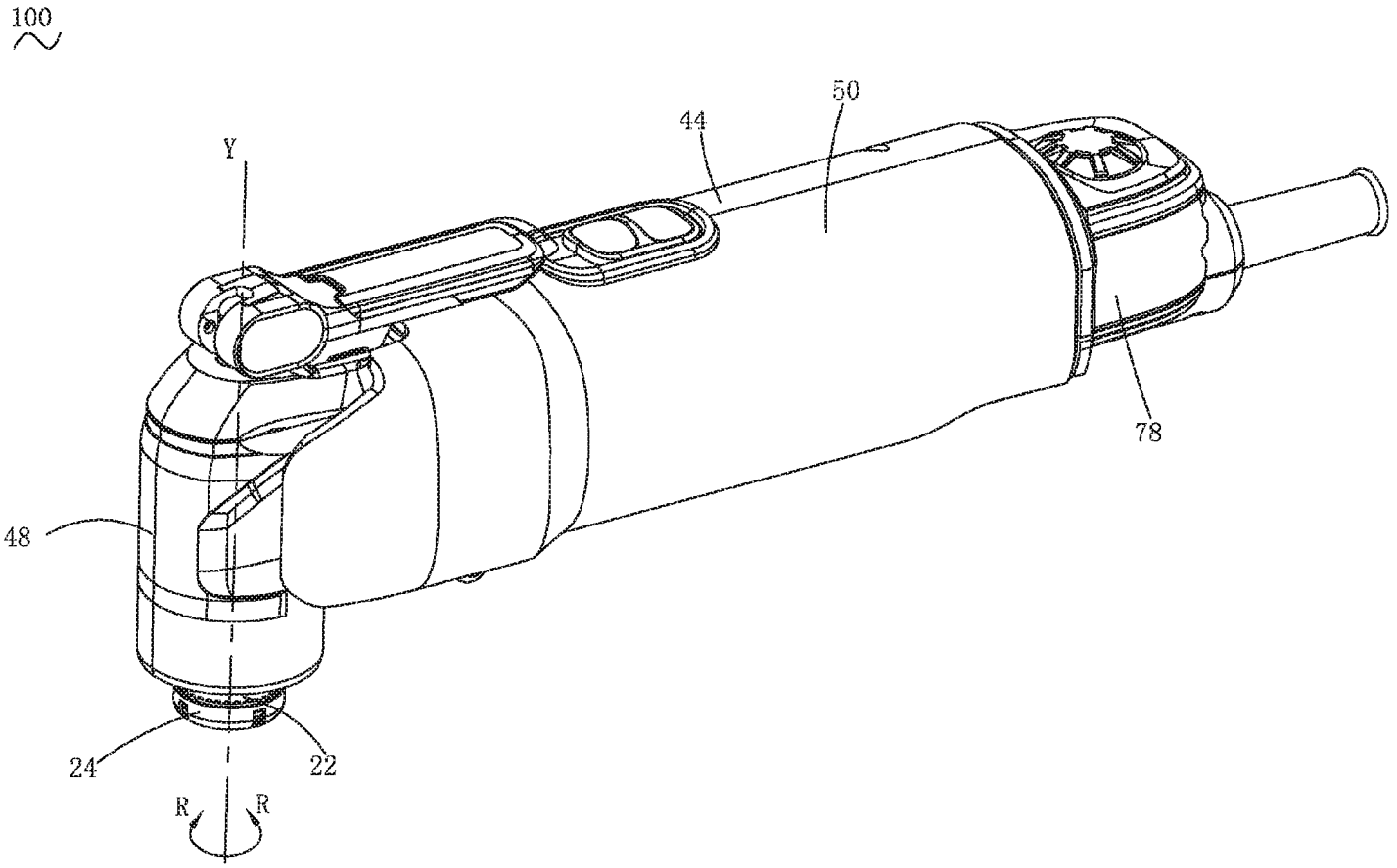
FIG. 1 is a space diagram of a power tool provided by a first embodiment of the present invention.
Figure 2:
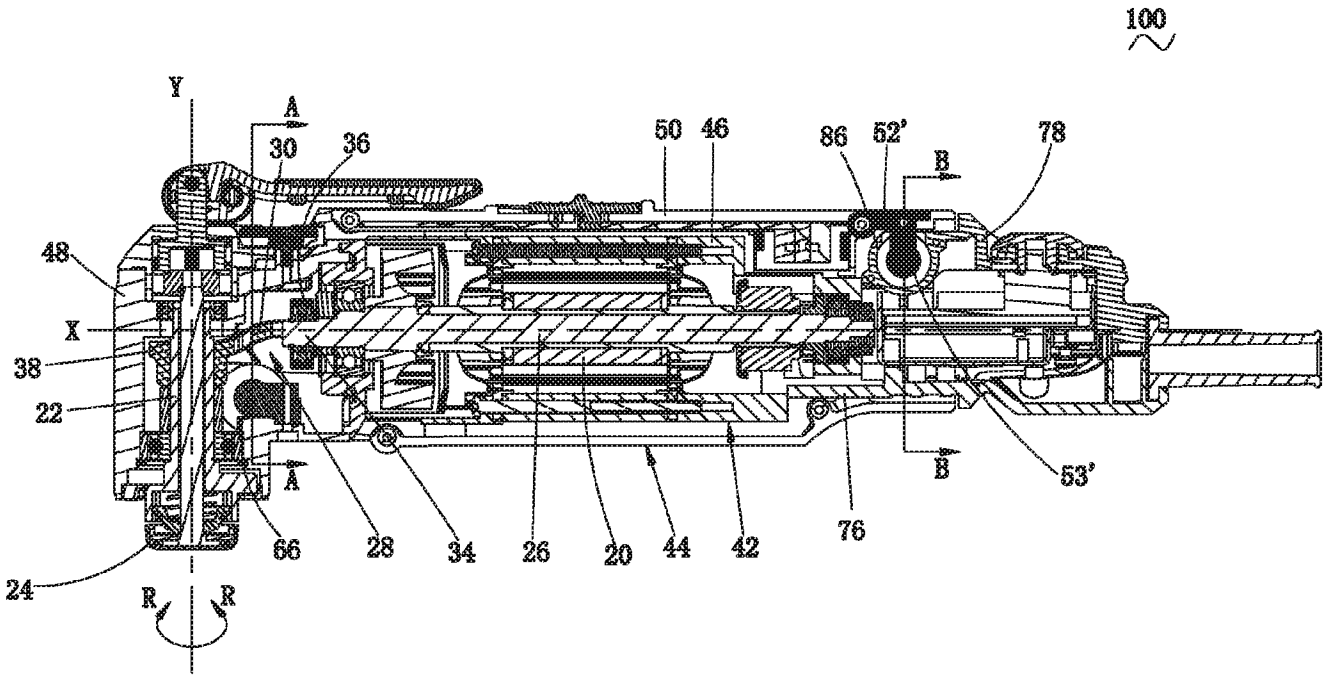
FIG. 2 is a longitudinal section view of a power tool as shown in FIG. 1.

Referring to FIGS. 1 and 2, the oscillating power tool 100 of the present embodiment comprises a housing, a motor 20 and an output shaft 22 driven by the motor 20 and used for mounting a cutting tool (not shown), and a fixing member 24 is matched with a free end of the output shaft 22 to fix the cutting tool on the output shaft 22.

In the present embodiment, the motor 20 has a motor shaft 26, and the axis X of the motor shaft 26 is approximately vertical to the axis Y of the output shaft 22. Preferably, the axis X of the motor shaft 26 and the axis Y of the output shaft 22 are coplanar, and a central plane XY is formed. Those skilled in the art can conceive that axis X of the motor shaft 26 and the axis Y of the output shaft 22 can be not coplanar or can be coplanar but not vertical, for example, the axis X of the motor shaft 26 and the axis Y of the output shaft 22 are parallel or at other angles.

An eccentric transmission mechanism 28 is disposed between the motor 20 and the output shaft 22, by the eccentric transmission mechanism 28, the rotational movement of the motor shaft 26 is converted into the rotational reciprocating oscillating movement of the output shaft 22 around the axis Y per se, and a oscillating direction is as shown by the arrow R-R in FIG. 1 and FIG. 2. When the free end of the output shaft 22 is connected to different cutting tool accessories, for example, a straight saw web, a round saw web, a triangular dull polishing plate, etc., operations such as cutting or grinding can be realized.

The cutting tool oscillates along with the output shaft 22 to form a oscillating plane. The oscillating plane can be regarded as the plane formed by oscillating of any straight line, vertical to the output shaft 22, on the cutting tool along with the output shaft 22. The oscillating plane is vertical to the central plane XY and vertical to the axis Y of the output shaft 22. In a position where the oscillating power tool as shown in FIG. 2 is, the central plane XY is a paper plane where FIG. 2 is, and the oscillating plane is vertical to the paper plane and vertical to the axis Y of the output shaft 22.

Figure 3:
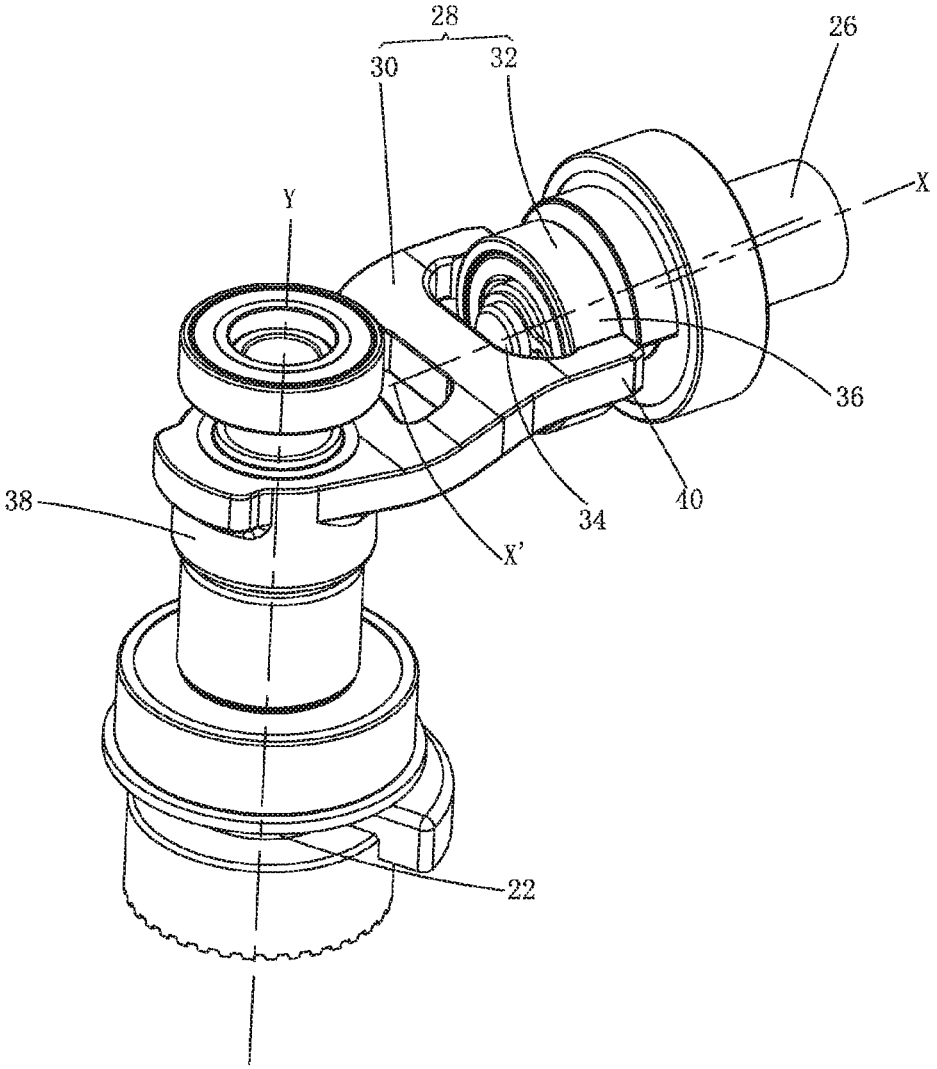
FIG. 3 is a space diagram of a transmission mechanism of a power tool as shown in FIG. 2.

In combination with FIG. 2 and FIG. 3, the eccentric transmission mechanism 28 comprises a shift fork 30 and an eccentric component 32 connected on the motor shaft 26. The shift fork 30 comprises a sleeve 38 sleeving the output shaft 22 and a forklike part 40 extending from the top end of the sleeve 30 to the motor shaft 26. The eccentric component 32 comprises an eccentric shaft 34 connected on the motor shaft 26 and a bearing 36 mounted on the eccentric shaft 34, the forklike part 40 of the shift fork 30 is matched with the bearing 36, that is, the forklike part 40 of the shift fork 30 wraps both sides of the bearing 36 and makes tight slide contact with the outer surface of the bearing 36. In the present embodiment, the bearing 36 is a ball bearing and has a spherical outer surface matched with the forklike part 40 of the shift fork 30. The eccentric shaft 34 is eccentrically connected to the motor shaft 26, that is, the axis X' of the eccentric shaft 34 is not coincided with the axis X of the motor shaft 26, and is radially offset by certain interval. Of course, here, the bearing 36 in the eccentric component 32 can be set to be an eccentric bearing, thus, the eccentric shaft 34 can be set to be coaxial with the motor shaft 26, or not.

When the motor 20 drives the motor shaft 26 to rotate, the eccentric shaft 34 is driven by the motor shaft 26 to eccentrically rotate relative to the axis X of the motor shaft 26, and further, the bearing 36 is driven to eccentrically rotate relative to the axis X of the motor shaft 26. Under driving of the bearing, 36, the shift fork 30 performs rational reciprocating oscillating relative to the axis Y of the output shaft 22, and further the output shaft 22 is driven to perform rotational reciprocating oscillating around the axis Y per se. The output shaft 22 performs rotational reciprocating oscillating to drive a cutting tool mounted thereon to perform rotational reciprocating oscillating so as to machine a workpiece.

In the present embodiment, a oscillating angle of the output shaft 22 is 5°, and a oscillating frequency of the output shaft 22 is 18000 times per minute. By setting the oscillating angle of the output shaft to be 5°, working efficiency of the cutting tool is greatly improved, and when the cutting tool is a saw web, chippings can be conveniently discharged.

It needs to be noted that according to the oscillating power tool of the present invention, the oscillating angle of the output shaft 22 is not limited to 5°, and can be any value larger than or equal to 4°, for example, can be one of 4.1°, 4.3°, 4.5°, 4.7°, 5°, 5.2°, 5.5°, 5.7°, 6°, 6.3°, 6.5°, 6.8°, 7°, 7.2°, 7.5°, 7.7°, 8°, 9° or 10°, and can also be larger than 10°. The oscillating frequency of the output shaft 22 is also not limited to 18000 times per minute and is preferably larger than 10000 times per minute.

Referring to the experimental data in the following table, the table indicates a condition that the efficiency of the oscillating power tool is improved under large oscillating angles. It can be seen from the following table that when the oscillating angle of the output shaft is 6°, and when a precise saw web is used to cut white pin plates or medium density plates of the same size, the efficiency is improved by more than 0.7 compared with when the oscillating angle is 3°; while a standard saw web is used to cut the medium density plates, the efficiency is also improved by 50% compared with when the oscillating angle is 3°; and in addition, when a double break saw web is used to cut iron nails, the efficiency can be improved by 48%.

| Cut materials | | | Used time (S) | | |
|---|---|---|---|---|---|
| Type | Size (mm) | Saw web type | Oscillating angle is 6° | Oscillating angle is 3° | Efficiency improvement |
| White pine plate | 170 × 17 | Precise | 5 | 18 | 72% |
| Medium density plate | 240 × 12 | Precise | 8 | 32 | 75% |
| Medium density plate | 240 × 12 | Standard | 8 | 17 | 50% |
| Iron nails(10) | Φ3.3 | Double break | 15 | 29 | 48% |

There are many methods to increase the oscillating angle of the output shaft 22, for example, an outer ring diameter of the bearing 36 can be increased while a distance between two extending arms of the forklike part 40 of the shift fork 30 is increased. Or under the condition of not changing the size of the bearing 36, an interval between axes of the eccentric shaft 34 and the motor shaft 26 can be increased. Or the interval between the axis Y of the output shaft 22 and the bearing 36 can be reduced, and of course, at this point, a horizontal size of the forklike part 40 of the shift fork 30 needs to be reduced. The methods above can be matched for use so as to obtain larger oscillating angle.

Compared with prior art, the present embodiment overcomes the technical bias that people set the oscillating angle of the oscillating power tool to be lower than 4°, by setting the oscillating angle which is larger than or equal to 4° and meanwhile adopting the oscillating frequency larger than 10000 times per minute, the working efficiency of the oscillating power tool is greatly improved, and the technical problem that people want to solve for long term is solved.

However, since the oscillating angle is increased, larger vibration is generated inevitably, and such vibration will be transmitted to an operator through the holding part on the housing. Besides, since the oscillating movement is around the axis Y of the output shaft 22, the vibration in a direction vertical to the central plane XY will be increased, while the vibration will bring very much hidden troubles to the operator, therefore it is very necessary to reduce the vibration of the holding part.

Figure 4:
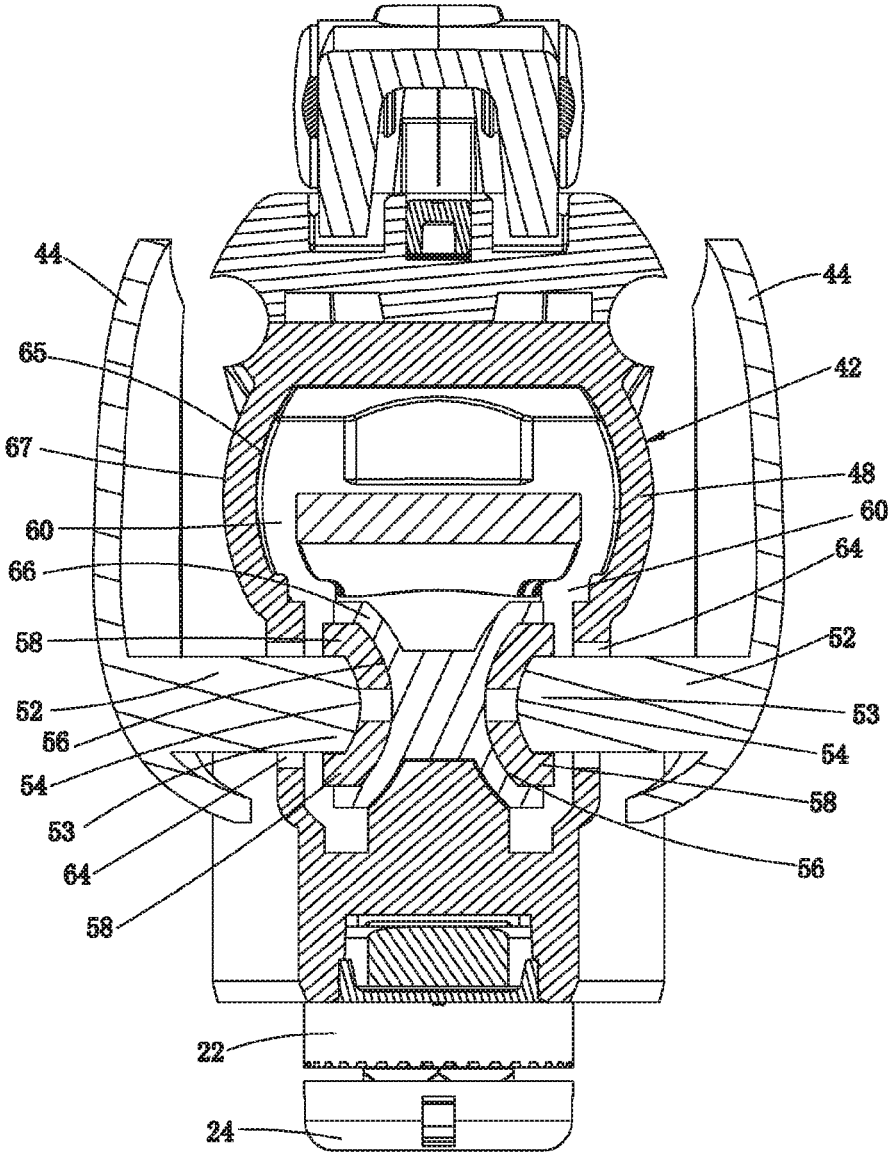
FIG. 4 is a section view of the power tool as shown in FIG. 2 along an A-A direction.

In combination with FIG. 2 and FIG. 4, in order to reduce the vibration of the holding part on the housing and improve operation comfortableness, in the present embodiment, the housing comprises a first housing 42 and a second housing 44 separated at intervals, and in the present embodiment, the second housing 44 is disposed outside the first housing 42. Of course, the creative concept of the present invention can also be realized by disposing the first housing outside the second housing.

The first housing 42 is called as inner housing, and the second housing 44 is called as outer housing. There is a clearance between the first housing 42 and the second housing 44, which can avoid direct transmission of the vibration from the first housing 42 to the second housing 44. Preferably, the clearance between the first housing 42 and the second housing 44 is larger than or equal to 0.5 mm but smaller than or equal to 4 mm. More preferably, the clearance between the first housing 42 and the second housing 44 is larger than or equal to 0.5 mm but smaller than or equal to 2 mm. Not only is the vibration reduced, but also the size of the whole oscillating power tool is reduced and holding comfortableness is improved.

The first housing 42 comprises a motor housing 46 for mounting the motor 20 and a head housing 48 for receiving part of the output shaft 22. The second housing 44 is provided with a holding part 50.

The motor housing 46 is used for mounting the motor 20, and can be designed to partially or totally wrap the motor 20 according to needs.

The head housing 48 contains part of the output shaft 22, and a free end of the output shaft 22 extends out of the head housing 48 to be conveniently matched and connected with the fixing member 24 so as to better clamp the cutting tool.

The second housing 44 is provided with the holding part 50. In the present embodiment, the holding part 50 comprises at least part of outer profile of the second housing 44 back to the motor 20, and an operator can operate the oscillating power tool 100 by holding the outer profile of the second housing 44, and the holding is convenient and reliable. Those skilled in the art can conceive that an extra holding handle can be mounted on the second housing 44.

By disposing the double-layer housing, the vibration of the motor 20 and the output shaft 22 passes by the first housing 42 and is then transmitted to the second housing 44 outside the first housing 42, the vibration is attenuated through obstruction of the first housing 42, and the vibration transmitted to the holding part 50 on the second housing 44 can be reduced.

As mentioned above, the working efficiency of the oscillating power tool can be increased by increasing the oscillating angle of the output shaft, but while the working efficiency is improved, the vibration of the oscillating power tool is necessarily increased. According to the oscillating power tool of the present embodiment, while the working efficiency is improved by increasing the oscillating angle of the output shaft, the vibration is reduced by setting a double-housing vibration damping solution, such that the operation comfortableness is considered while the working efficiency is improved, and the oscillating power tool is easier and more comfortable to operate.

In order to further reduce the vibration, a vibration damping device is disposed between the first housing 42 and the second housing 44. Specifically, the first housing 42 has a first side back to the second housing 44, the first side is provided with a supporting member 66, the second housing 44 is provided with a connecting unit, which has an abutting member facing the first side, the vibration damping device is disposed between the supporting member and the abutting member, and here, the vibration damping device comprises a vibration damping element.

The first housing 42 comprises a head housing 48 receiving part of the output shaft 22 and a motor housing 46 for mounting the motor 20. In the present embodiment, the vibration damping device is disposed both between the head housing 48 and the second housing 44 and between the motor housing 46 and the second housing 44. While those skilled in the art can conceive of only disposing the vibration damping device between the head housing 48 and the second housing 44 or only between the motor housing 46 and the second housing 44.

Referring to FIG. 4, the vibration damping device is disposed between the head housing 48 and the second housing 44.

The head housing 48 comprises an outer profile 67, an inner profile 65 and an internal receiving space 60 in a region of the second housing 44, wherein the internal receiving space 60 and the outer profile 67 are communicated by a through hole 64. The first side back to the second housing 44 comprises the inner profile 65 and the internal receiving space 60. That is to say, the supporting member 66 can be disposed or formed on the inner profile 65, and can also be disposed in the internal receiving space 60. In the present embodiment, the supporting member 66 is disposed in the internal receiving space 60.

The second housing 44 is provided with a connecting unit, extending to the first side, that is, the connecting unit extends into the internal receiving space 60, and the vibration damping device is disposed between the connecting unit and the supporting member.

The connecting unit comprises an abutting member 53 facing the first side, and the vibration damping device is disposed between the abutting member 53 and the supporting member 66. Here, "the abutting member 53 faces the first side" means that the abutting member 53 is located in the internal receiving space 60. The abutting member 53 is provided with an abutting surface 54, which is located in the internal receiving space 60. The supporting member 66 is provided with a contact surface 56 opposite to the abutting surface 54, and the vibration damping device comprises a vibration damping element 58 that is disposed between the abutting surface 54 and the contact surface 56.

The connecting unit further comprises a connector 52 connected to the second housing 44, and the abutting member 53 is fixedly connected to the connector 52. The connector 52 extends to the first side through the through hole 64, such that the abutting surface 54 is located in the internal receiving space 60. Of course, the connector 52 and the abutting member 53 can also be integrally formed. The vibration damping element 58 can be elastically deformed to resist an internal friction force caused by damping, such that the vibration transmitted to the second housing 44 from the first housing 42 is reduced, in other words, the vibration damping element 58 is a force transmission member.

Specifically, the first housing 42 has certain thickness and has an inner profile 65 and an outer profile 67, that is, the inner profile 65 and the outer profile 67 are separated by certain distance, and preferably the thickness of the first housing 42 is not changed. The inner profile 65 gets away from the second housing 44 relative to the outer profile 67, one side of the inner profile 65 of the first housing 42 away from the outer profile 67 has an internal receiving space 60, and the second housing 44 is located on one side of the outer profile 67 of the first housing away from the inner profile 65. The through hole 64 penetrates through the inner profile 65 and the outer profile 67, and the connecting unit penetrates through the through hole 64 to extend into the internal receiving space 60.

The vibration damping element 58 is disposed between the abutting surface 54 on the connecting unit and the contact surface 56 in the internal receiving space 60 of the first housing 42, while the connecting unit is disposed on the second housing 44, which is equivalent to that the vibration damping element 58 is disposed between the second housing 44 and the first housing 42, the vibration transmitted to the second housing 44 from the first housing 42 can be obviously reduced, and operation comfortableness can be greatly improved.

Besides, since the abutting surface 54 and the contact surface 56 are both located in the internal receiving space 60 of the first housing 42, in this way, the vibration damping element 58 between the abutting surface 54 and the contact surface 56 can also be disposed in the internal receiving space 60 of the first housing 42, a residual space in the first housing 42 can be fully used without increasing the size of the whole oscillating power tool 100, and the holding comfortableness of an operator can also be improved by the oscillating power tool 100 of a smaller size.

In the present embodiment, the connector 52 and the abutting member 53 of the connecting unit are integrally formed and are longitudinally rod-shaped, one end of the connector 52 is connected to the second housing 44, and one end of the abutting member 53 is the abutting surface 54. That is, the connector 52 and the abutting member 53 of the connecting unit have the same extending direction. While in order for the vibration damping effect, extending direction of the connector 52 is vertical to the central plane XY. Of course, the extending direction of the abutting member 53 and that of the connector 52 can be at an angle, for example, 90 degrees or other degrees. There is a clearance between the connecting unit and the through hole 64, and the connecting unit penetrates through the through hole 64 to extend into the internal receiving space 60 of the head housing 48.

In the present embodiment, the number of the connecting units is two, and the two connecting units are symmetrically disposed relative to the axis Y of the output shaft 22. Preferably, the plane where the axis Y of the output shaft 22 is positioned is defined as the middle plane, and the two connecting units are symmetrically disposed relative to the middle plane. Preferably, the middle plane is disposed by being parallel with the axis X of the motor shaft 26. More preferably, the two connecting units are symmetrically disposed relative to a central plane XY determined by the axis X of the motor shaft 26 and the axis Y of the output shaft 22.

The connection between connector 52 of the connecting unit and the second housing 44 can be that the connector 52 is integrally formed on the second housing 44, or the connector 52 is mounted on the second housing 44. There are various mounting manners, such as screw connection or interference fit, or welding and other mounting manners. In the technical solution, the second housing 44 is made of plastic, the connector 52 and the second housing 44 are integrally formed, and the connector 52 is also made of plastic. Those skilled in the art can conceive that except for the plastic, the connector 52 can also be made of a metal material, for example, aluminum alloy to improve the strength and service life.

When the connecting unit is connected to the second housing 44, the connecting unit can be regarded as part of the second housing 44, part of the connecting unit extends into the internal receiving space of the first housing 42, which is equivalent to that part of the second housing 44 extends into the internal receiving space of the first housing 42, the second housing 44 and the first housing 42 are intercrossed, and the vibration damping element 58 is disposed between the first housing 42 and the second housing 44 which are intercrossed. That is to say, in the technical solution, "between the first housing and the second housing" does not require a specific wrapping relation between the first housing and the second housing (for example, the first housing is totally wrapped in the second housing) as long as the first housing and the second housing are respectively provided with a first portion (first part) and a second portion (second part) opposite to each other, and then "between the first portion (first part) and the second portion (second part)" can be called as "between the first housing and the second housing."

In the technical solution, the inner profile 65 of the head housing 48 is provided with a supporting member 66, and the contact surface 56 is disposed on the supporting member 66. Preferably, the contact surface 56 is integrally formed on the supporting member 66, and the contact surface 56 is a surface of the supporting member 66. The supporting member 66 is mounted on the head housing 48 by screws and is received in the internal receiving space 60 wrapped by the inner profile 65 of the head housing 48. The contact surface 56 is disposed on the supporting member 66, and the structural design is simple. Those skilled in the art can conceive of designing the inner profile 65 of a proper shape and directly using part of the inner profile 65 per se as the contact surface 56.

Preferably, the contact surface 56 is disposed in the internal receiving space 60 between the output shaft 22 in the head housing 48 and the motor shaft 26. In the present embodiment, the internal receiving space 60 between the output shaft 22 and the motor shaft 26 is located in the head housing 48, and those skilled in the art can conceive that the internal receiving space 60 between the output shaft 22 and the motor shaft 26 can also be located in the motor housing 46.

In the technical solution, the axis Y of the output shaft 22 and the axis X of the motor shaft 26 of the motor 20 are vertically disposed, the shift fork 30 of the eccentric transmission mechanism 28 is connected to the motor shaft 26 and the output shaft 22 while the shift fork 30 occupies a smaller size, therefore, by disposing the supporting member 66 and the contact surface 56 in the internal receiving space 60 between the motor shaft 26 and the output shaft 22, a space between the motor 20 and the output shaft 22 can be fully used without increasing the size of the oscillating power tool 100.

In the technical solution, the forklike part 40 of the shift fork 30 and the motor shaft 26 are approximately parallel and the sleeve 38 of the shift fork 30 is connected to the top end of the output shaft 22 away from the free end. Therefore, preferably, the supporting member 66 and the contact surface 56 are disposed on one side of the shift fork 30 close to the free end of the output shaft 22. The space below the shift fork 30 can be fully used, and the structural layout is reasonable.

The vibration damping element 58 is disposed between the abutting surface 54 and the contact surface 56. Specifically, the vibration damping element 58 is concave, and the abutting surface 54 is matched with the inner concave shape of the vibration damping element 58. One of the abutting surface 54 and the contact surface 56 is a convex surface, and the other of the abutting surface 54 and the contact surface 56 is a concave surface. In the present embodiment, the abutting surface 54 is the convex surface and the contact surface 56 is of the concave surface.

The abutting surface 54 is matched with the shape of the inner concave part of the vibration damping element 58, by this disposing manner, the vibration damping element 58 not only makes contact with the end surface of the abutting member 53 but also makes contact with part of the outer surface extending from the end surface of the abutting member 53 to a direction of the connector 52, the abutting surface 54 comprises the end surface of the abutting member 53 and part of the outer surface connected to the end surface, such that not only is the vibration in an axial direction of the abutting member 53 reduced, but also the vibration in a peripheral direction of the abutting member 53 is reduced. In the technical solution, the end part of the abutting surface 54 of the abutting member 53 is an arc surface, and those skilled in the art can conceive that the end part can also be planar, spherical or other shapes expect for the arc surface.

Preferably, the contact surface 56 is concave, and the vibration damping element 58 is matched with the shape of the contact surface 56 and is at least partially received in the contact surface 56. The concave vibration damping element 58 is received in the concave contact surface 56, by this disposing manner, not only is the vibration in an axial direction of the contact surface 56 reduced, but also the vibration in a peripheral direction of the contact surface 56 is also reduced. Those skilled in the art can conceive that the contact surface 56 and the vibration damping element 58 are matched and connected in other shapes, for example, in planar abutting.

In the present embodiment, the number of the connecting units is two while the number of the supporting member 66 can be one, and the supporting member 66 is provided with two contact surfaces 56, whose openings face opposite directions. Specifically, a cross section of the supporting member 66 is approximately X-shaped on a plane parallel with the output shaft 22 and vertical to the motor shaft 26, and the two concave parts of the supporting member 66 form the contact surface 56.

Preferably, the two contact surfaces 56 are symmetrically disposed relative to the axis Y of the output shaft 22. Preferably, the two contact surfaces 56 are symmetrically disposed relative to the central plane XY determined by the axis Y of the output shaft 22 and the axis X of the motor shaft 26, such that the two vibration damping elements 58 are symmetrically disposed relative to the central plane XY and the structural layout is reasonable.

The vibration damping element 58 is made of an elastic material, for example a part made of PU, rubber, elastic metal and other materials, or a part made by combination of these materials, or part combination made of different single materials.

The vibration damping element 58 is disposed in the internal receiving space 60 of the head housing 48, correspondingly, part of the second housing 44 provided with the connecting unit is located outside the head housing 48 of the first housing 42, if the head housing 48 of the first housing 42 is regarded as the first head housing, then the part of the second housing 44 provided with the connecting unit can be regarded as the second head housing. The vibration damping element 58 can reduce the vibration transmitted to the second head housing from the first head housing. The vibration damping device disposed between the head housing 48 and the second housing 44 can be called as head housing vibration damping device.

The plane where the axis Y of the output shaft 22 is positioned is a middle plane, and one head housing vibration damping device is disposed one each of both sides of the middle plane. Preferably, the middle plane is disposed by being parallel with the axis X of the motor shaft 26. More preferably, the two head housing vibration damping devices are symmetrically disposed relative to a central plane determined by the axis X of the motor shaft 26 and the axis Y of the output shaft 22. Those skilled in the art can conceive of only disposing the head housing vibration damping device on any side of the middle plane.

The applicant found that although the vibration damping element can reduce the vibration, the condition is not always like a conventional thought that the more the vibration damping elements are, the better the vibration damping effect is, and when the number of the vibration damping elements exceeds a certain value, the vibration damping effect is reduced instead. According to the technical solution, preferably, the number of the vibration damping elements on one side of the middle plane is 2-5. When being disposed on one side of the middle plane, the 2-5 vibration damping elements can be called as a head housing vibration damping device. Of course, preferably, 2-5 vibration damping elements are disposed on both sides of the middle plane, and most preferably, the vibration damping elements disposed on both sides of the middle plane are same in number and are symmetrically disposed. All technical solutions same as or similar to the present technical solution should fall within a protective scope of the present invention.

Figure 5:
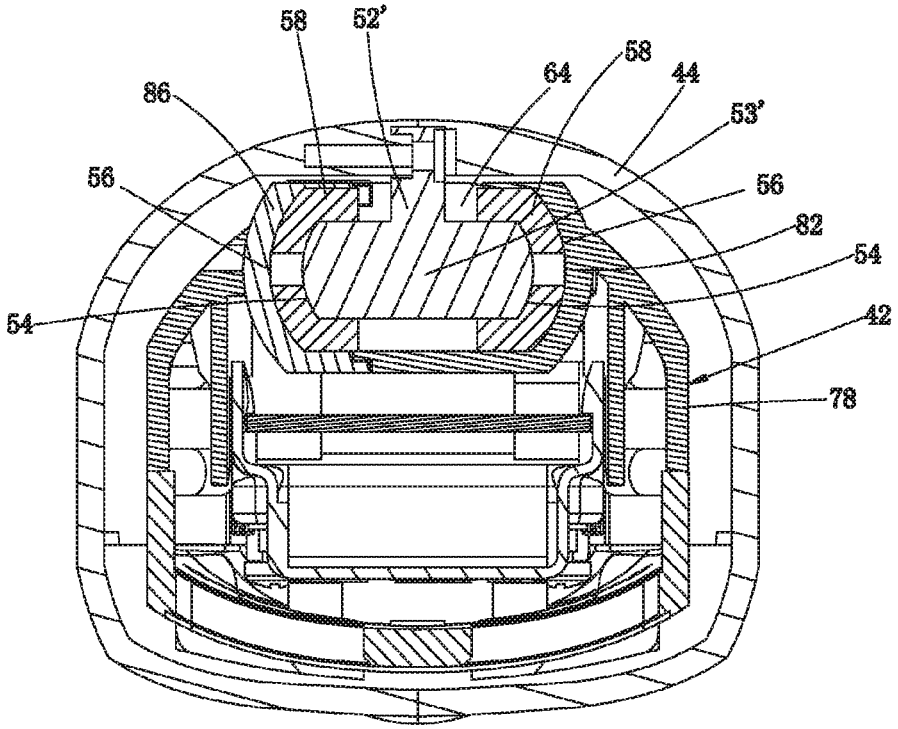
FIG. 5 is a section view of the power tool as shown in FIG. 2 along a B-B direction.
Figure 6:
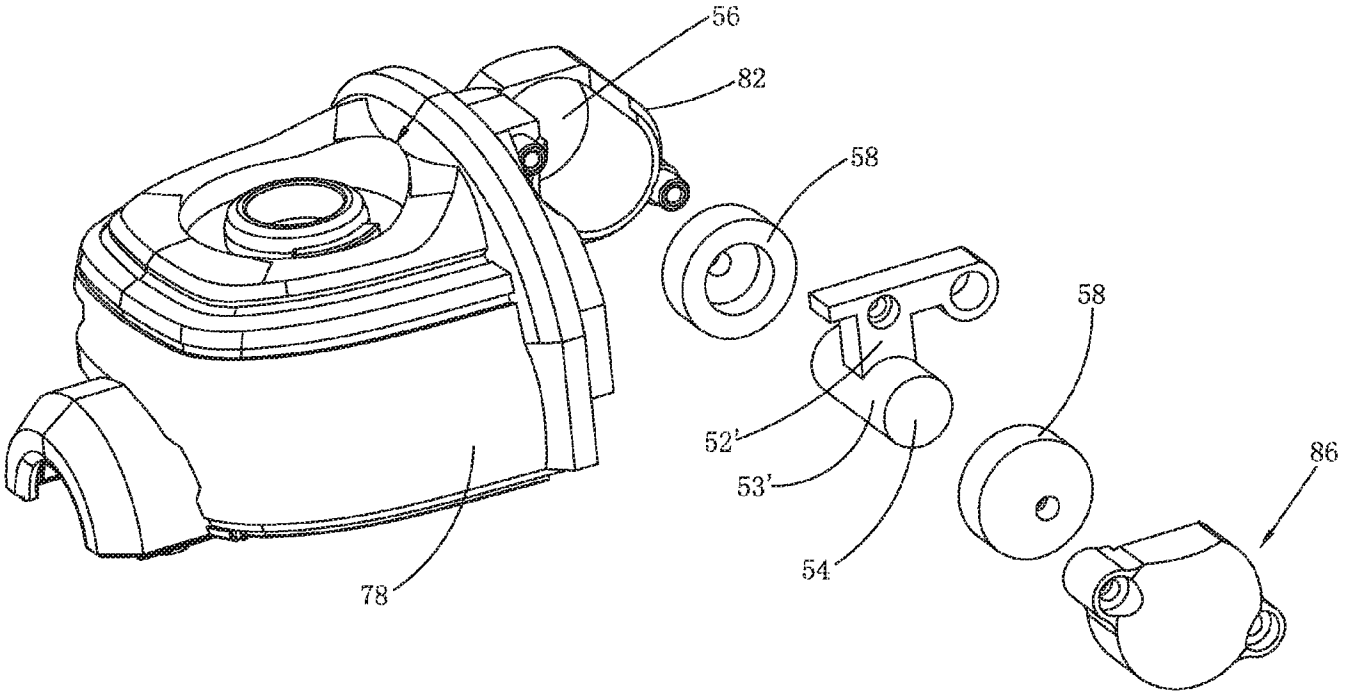
FIG. 6 is an exploded schematic diagram of part of structures of vibration damping elements mounted on the back side of a motor housing of the power tool as shown in FIG. 2.

The vibration damping device disposed between the motor housing 46 and the second housing 44 is shown in combination with FIG. 2, FIG. 5 and FIG. 6.

Many parts, such as the abutting surface 54, the vibration damping element 58, the shape and material of the contact surface 56 and the like, of the vibration damping device, which are same as those of the vibration damping device disposed between the head housing 48 and the second housing 44 are not repeated here.

The difference lies in a specific structure of the connecting unit. Here, the connecting unit comprises a connector 52' and an abutting member 53' connected to each other, and the connector 52' is connected to the second housing 44 and penetrates through the through hole 64 disposed in the first housing 42, the abutting member 53' is located in the internal receiving space of the first housing 42, and the abutting surface 54 is disposed on the abutting member 53'. In the present embodiment, the end part of the connector 52' away from the second housing 44 is connected to the middle of the abutting member 53', and the abutting surface 54 is disposed on two tail ends of the abutting member 53'. An extending direction of the abutting member 53' is vertical to that of the connector 52', while the extending direction of the connector 52' is parallel with the central plane XY. The abutting surface 54 is a convex surface, and the abutting member 53' is provided with two abutting surfaces 54 back to each other.

Two vibration damping elements 58 and two contact surfaces 56 are disposed respectively to be matched and connected with the two tail ends of the abutting member 53'.

In the technical solution, one end of the connector 52' away from the abutting member 53' longitudinally extends to connect the connector 52' with the second housing 44 by two screws, such that connection between the connector 52' and the second housing 44 is more reliable.

The number of the contact surfaces 56 is two, and the two contact surfaces 56 are symmetrically disposed relative to the axis X of the motor shaft 26. Preferably, openings of the two contact surfaces 56 face opposite directions.

The contact surface 56 is disposed in the internal receiving space of the motor housing 46 away from the tail of the output shaft 22. Under general conditions, main body parts (for example, a stator and a rotor) of the motor 20 are larger, while the parts (for example, a commutator and a support bearing) on one side of the main body of the motor 20 away from the output shaft 22 are smaller in size, therefore, by disposing the contact surface 56 in the internal receiving space of the motor housing 46 away from the tail of the output shaft 22, a residual space in the motor housing 46 can be fully used, the structural layout is reasonable, the size of the motor housing 46 is not increased, and operation comfortableness is improved.

The motor housing 46 comprises a first half housing 76 and a second half housing 78 connected to each other, the first half housing 76 is used for mounting main body parts with larger size of the motor 20, for example, a stator and a rotor, and the second half housing 78 is disposed on one side of the first half housing 76 away from the output shaft 22. As mentioned above, the number of the contact surfaces 56 is two, and in the present technical solution, the two contact surfaces 56 are integrally formed on the second half housing 78 of the motor housing 46. Specifically, the end part of the second half housing 78 facing the motor 20 is integrally provided with a cylindrical receiving part 82 with one closed end, and an extending axis of the cylindrical receiving part 82 is vertical to the axis X of the motor shaft 26. The second half housing 78 further comprises a lid 86 detachably connected to the cylindrical receiving part 82, an opening of the lid 86 is opposite to the opening of the cylindrical receiving part 82, and a space encircled by the two is part of the internal receiving space of the motor housing 46. Here, the abutting member 53' faces the first side, which means that the abutting member 53' is located in the space encircled by the lid 86 and the cylindrical receiving part 82. The lid 86 and the cylindrical receiving part 82 are connected by screws, and the structure is simple. The first contact surface is an inner profile of the closed end of the cylindrical receiving part 82, and the second contact surface is a concave inner profile of the lid 86, such that openings of the two contact surfaces 56 face opposite directions.

During mounting, one vibration damping element 58 is embedded into the cylindrical receiving part 82, one end of the abutting member 53' of the connecting unit is abutted against one vibration damping element 58, then another vibration damping element 58 is abutted against the other end of the abutting member 53', then the lid 86 contains the second vibration damping element 58 and is connected to the cylindrical receiving part 82 by screws, then the second half housing 78 is connected to the first half housing 76, and finally, the second housing 44 is mounted on the connector 52'. The structural layout is reasonable and the mounting process is convenient.

The vibration damping element 58 is located in the internal receiving space of the motor housing 46, correspondingly, part of the second housing 44 provided with the connecting unit is located outside the motor housing 46 of the first housing 42, if the motor housing 46 of the first housing 42 is regarded as the first motor housing, then the part of the second housing 44 provided with the connecting unit can be regarded as the second motor housing. The vibration damping element can reduce vibration transmitted to the second motor housing from the first motor housing. The vibration damping device disposed between the motor housing 46 and the second housing 44 can be called as head housing vibration damping device.

The plane where the axis Y of the output shaft 22 is positioned is a middle plane, and one head housing vibration damping device is disposed one each of both sides of the middle plane. Preferably, the middle plane is disposed by being parallel with the axis X of the motor shaft 26. More preferably, the two motor housing vibration damping devices are symmetrically disposed relative to a central plane determined by the axis X of the motor shaft 26 and the axis Y of the output shaft 22. Those skilled in the art can conceive of only disposing the head housing vibration damping device on any side of the middle plane.

Of course, those skilled in the art can conceive that the connecting unit disposed between the head housing and the second housing and that disposed between the motor housing and the second housing are interchangeable; or the connecting unit between the head housing and the second housing as described above can be disposed both between the head housing and the second housing and between the motor housing and the second housing; similarly, the connecting unit between the motor housing and the second housing as described above can be disposed both between the head housing and the second housing and between the motor housing and the second housing. Besides, the two connecting units and two vibration damping elements disposed on one side of the middle plane are not limited to be disposed between the head housing and the second housing and between the motor housing and the second housing, and can be both disposed between the motor housing and the second housing or between the head housing and the second housing.

The applicant found that although the vibration damping element can reduce the vibration, the condition is not always like a conventional thought that the more the vibration damping elements are, the better the vibration damping effect is, and when the number of the vibration damping elements exceeds a certain value, the vibration damping effect is reduced instead. According to the technical solution, preferably, the number of the vibration damping elements on one side of the middle plane is 2-5. When being disposed on one side of the middle plane, the 2-5 vibration damping elements can be called as head housing vibration damping device. Of course, preferably, 2-5 vibration damping elements are disposed on both sides of the middle plane, and most preferably, the vibration damping elements disposed on both sides of the middle plane are same in number and are symmetrically disposed. The technical solutions same as the present technical solution or similar technical solutions all fall within a protective scope of the present invention.

Second Embodiment

Figure 7:
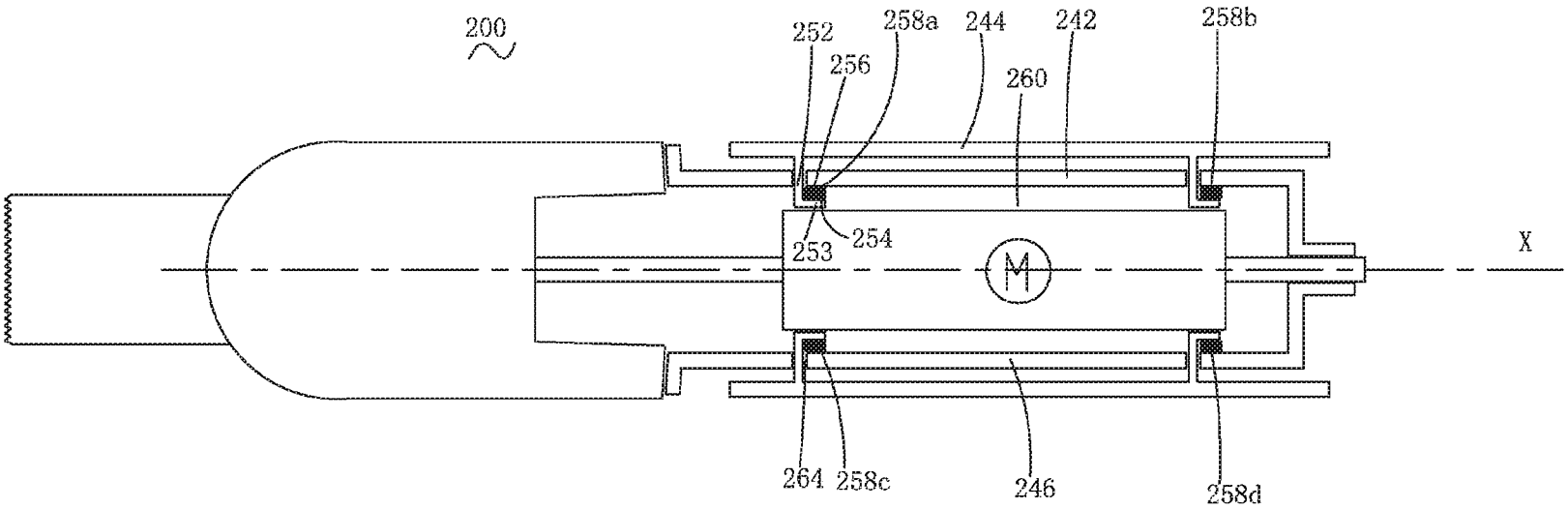
FIG. 7 is a simplified schematic diagram of a power tool provided by a second embodiment of the present invention.

FIG. 7 shows a simplified schematic diagram of a power tool 200 provided by a second embodiment of the present disclosure.

In order to make the specification concise, the main difference between the power tool 200 of the present embodiment and the oscillating power tool 100 of the first embodiment is mainly described hereinafter.

In the present embodiment, four connecting units of the same structure are disposed between a first housing 242 and a second housing 244, wherein each connecting unit comprises a connector 252 and an abutting member 253 vertical to the connector 252, a first end of the connector 252 is connected to the second housing 244, a second end of the connector 252 extends into an internal receiving space 260 of the first housing 242 by a through hole 264 disposed in the first housing 242, the abutting member 253 is connected to the second end of the connector 252, and an abutting surface 254 is an inner profile of the abutting member 253 facing the first housing 242.

Here, a first side of the first housing 242 back to the second housing 244 comprises an inner profile and the internal receiving space 260 of the first housing 242, the abutting member 253 faces the first side, and it can be that the abutting member 253 is located in the internal receiving space 260 and the abutting surface 254 faces the inner profile of the first housing 242. A supporting member is part of the inner profile. A contact surface 256 is disposed on part of the inner profile of the first housing 242, and the vibration damping elements **258*a*-258*d* are abutted between the abutting member 253 and the first housing 242**.

In the present embodiment, one end part of the abutting member 253 of the connecting unit is connected to the second end of the connector 252 away from the second housing, such that the connecting unit is L-shaped. Those skilled in the art can conceive that the middle of the abutting member 253 of the connecting unit can be connected to the second end of the connector 252, such that the connecting unit is T-shaped. In the present embodiment, the vibration damping elements **258*a*-258*d* are lump, and those skilled in the art can conceive that if the connecting unit is T-shaped, the vibration damping elements 258*a*-258*d*** can be annular correspondingly.

In the present embodiment, the number of the connecting units and the vibration damping elements is 4. Those skilled in the art can conceive that the number of the vibration damping elements can be set according to needs and is not limited to 4 exampled in the specific embodiment.

In the specific embodiment, specific position arrangement of the 4 vibration damping elements **258*a*-258*d* is: the 4 vibration damping elements 258 are all disposed in a motor housing 246 of the motor M, and the first vibration damping element 258*a* and the second vibration damping element 258*b* are axially disposed at intervals relative to the axis X of the motor M. The third vibration damping element 258*c* and the first vibration damping element 258*a* are peripherally disposed at intervals relative to the axis X of the motor M. Preferably, the third vibration damping element 258*c* and the first vibration damping element 258*a* are peripherally disposed at an interval of 180 degrees relative to the axis X of the motor M, which enables the third vibration damping element 258*c* and the first vibration damping element 258*a* to be symmetrically disposed relative to the axis X of the motor M. The fourth vibration damping element 258*d* and the second vibration damping element 258*b* are peripherally disposed at intervals relative to the axis X of the motor M. Preferably, the fourth vibration damping element 258*d* and the second vibration damping element 258*b* are peripherally disposed at an interval of 180 degrees relative to the axis X of the motor M, which enables the fourth vibration damping element 258*d*** and the second vibration damping element 258*b* to be symmetrically disposed relative about the axis X of the motor M. By such disposing manner, the structural layout is regular, and design is reasonable.

Third Embodiment

Figure 8:
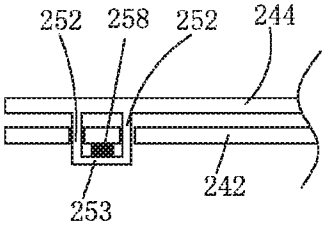
FIG. 8 is a simplified schematic diagram of a vibration damping structure of a power tool provided by a third embodiment of the present invention.

FIG. 8 shows a simplified schematic diagram of a vibration damping structure of a power tool provided by a third embodiment of the present invention;

The difference between the power tool of the present embodiment and the power tool 200 of the second embodiment lies in that the connecting unit is in a square shape with an open side and comprises an abutting member 253 and two connectors 252, the two connectors are disposed by being separated for certain distance, and the abutting member 253 is connected to both the two connectors 252. Specifically, the two connectors 252 are same in length and are parallel, the ends of the two connectors 252 on the same side are connected to the second housing 244, the first housing 242 has two through holes separated by certain distance, the two connectors 252 respectively penetrate through these two through holes and extend into the internal receiving space of the first housing 242, the abutting member 253 is located in the internal receiving space of the first housing 242 and is connected to the end parts of the two connectors 252 away from the second housing 244, and the vibration damping element 258 is abutted between the inner profile of the first housing 242 and the abutting member 253.

Fourth Embodiment

FIG. 9 to FIG. 15 show a power tool 300 provided by a fourth embodiment of the present invention.

Figure 9:
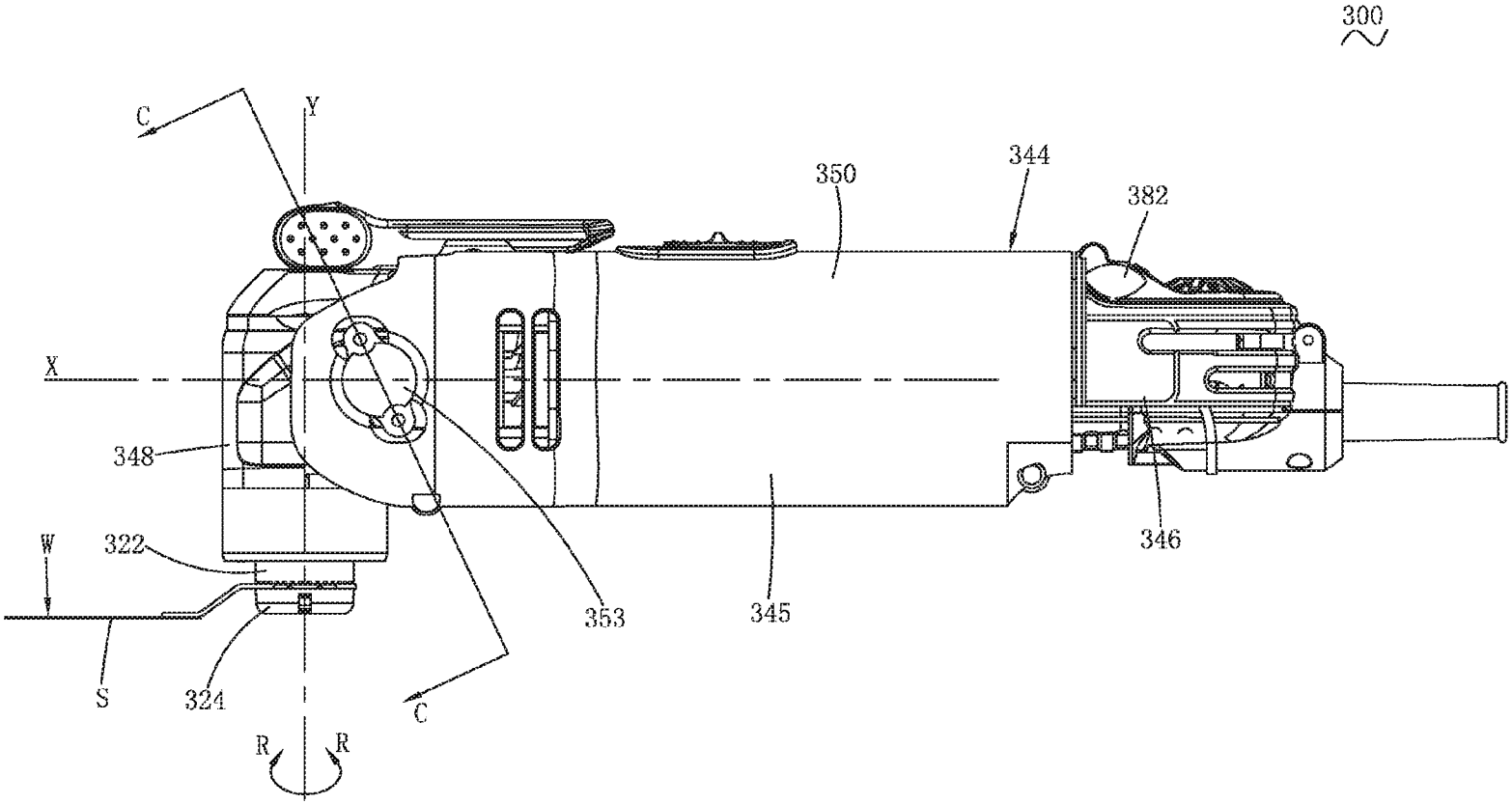
FIG. 9 is a main view of a power tool provided by a fourth embodiment of the present invention.
Figure 10:
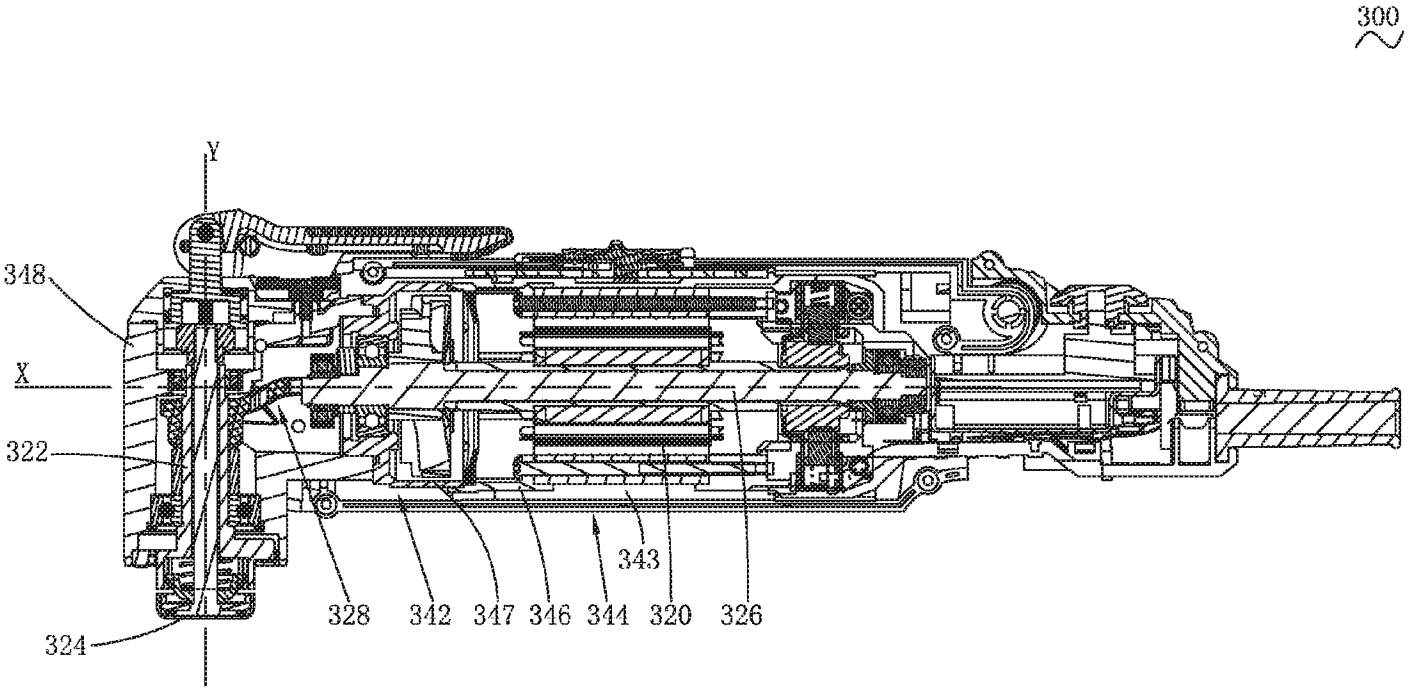
FIG. 10 is a longitudinal section view of the power tool as shown in FIG. 9 and in FIG. 10, the power tool is not provided with a cutting tool.

Referring to FIG. 9 to FIG. 10, the power tool 300 of the present embodiment is a oscillating power tool, comprising a housing, a motor 320 received in the housing and an output shaft 322 driven by the motor 320 and used for mounting a cutting tool W; and a fixing member 324 is matched with a free end of the output shaft 322 to fix the cutting tool W on the output shaft 322. The power tool 300 further comprises a holding part 350 disposed on the housing, and an operator controls the power tool to move relative to a workpiece by holding the holding part with hand so as to machine the workpiece.

In the present embodiment, the axis X of a motor shaft 326 of the motor 320 is approximately vertical to the axis Y of the output shaft 322. Preferably, the axis X of the motor shaft 326 and the axis Y of the output shaft 322 are coplanar, and a central plane XY is formed. Those skilled in the art can conceive that the axis X of the motor shaft 326 and the axis Y of the output shaft 322 can be not coplanar or can be coplanar but not vertical, for example, the axis X of the motor shaft 326 and the axis Y of the output shaft 322 are parallel or at other angles.

An eccentric transmission mechanism 328 is disposed between the motor 320 and the output shaft 322, by the eccentric transmission mechanism 328, the rotational movement of the motor shaft 326 is converted into the rotational reciprocating oscillating movement of the output shaft 322 around the axis Y per se, and a oscillating direction is as shown by the arrow R-R in FIG. 9 and FIG. 10. When the free end of the output shaft 322 is connected to different cutting tool accessories, for example, a straight saw web, a round saw web, a triangular dull polishing plate, operations such as cutting or grinding can be realized.

The cutting tool W oscillates along with the output shaft 322 to form an oscillating plane S. The oscillating plane S can be regarded as the plane formed by oscillating of any straight line on the cutting tool W vertical to the output shaft 322 along with the output shaft 322. The cutting tool W is a saw web, and any plane of the upper and lower surfaces of the saw web can be regarded as an oscillating plane of the saw web. The oscillating plane S is vertical to the central pane XY and vertical to the axis Y of the output shaft 322. In a position where the oscillating power tool as shown in FIG. 9 is, the central plane XY is a paper plane where FIG. 9 is, and the oscillating plane S is vertical to the paper plane and vertical to the axis Y of the output shaft 322.

The eccentric transmission mechanism 328 of the present embodiment is same as the eccentric transmission mechanism 28 of the oscillating power tool 100 of the first embodiment in structure, and is not repeated.

Figure 11:
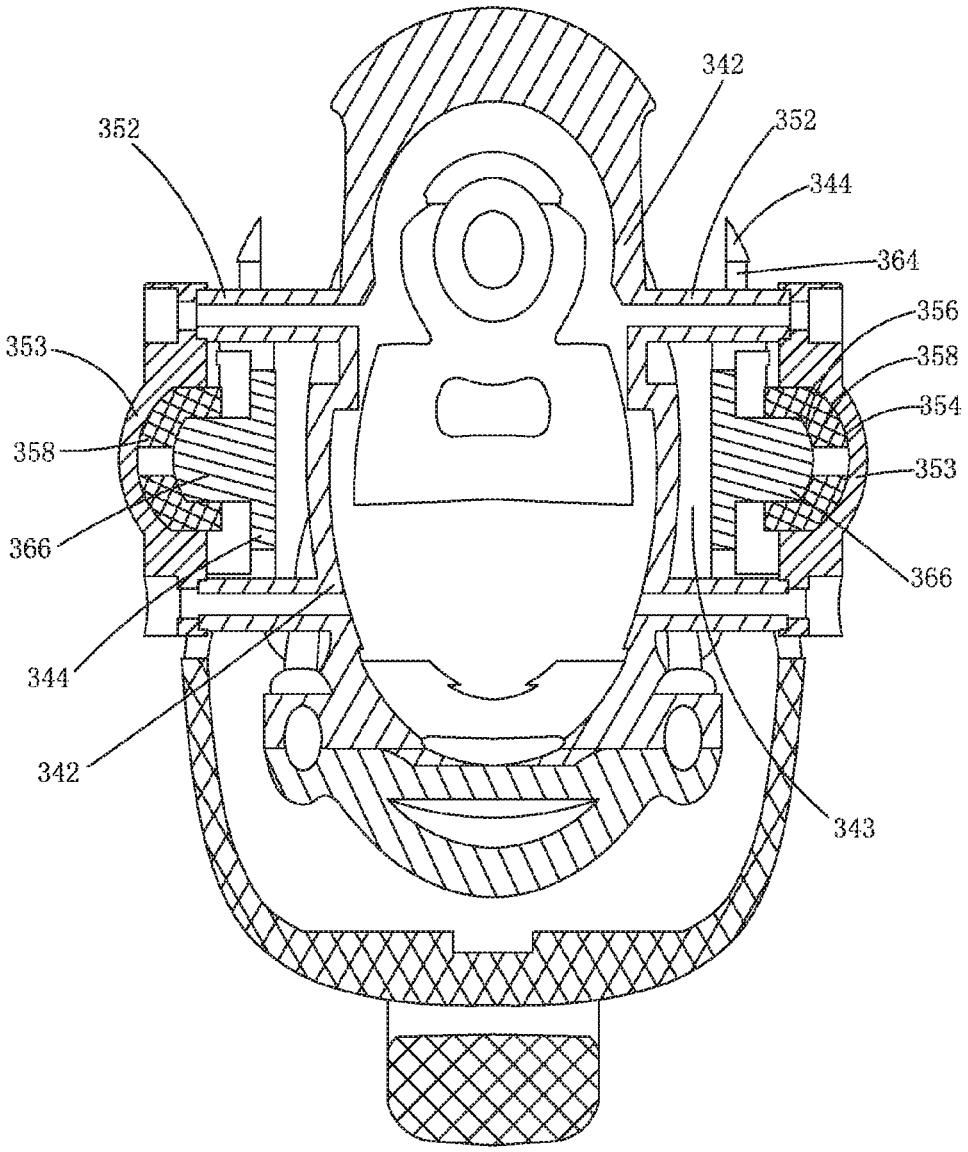
FIG. 11 is a section schematic diagram of the power tool as shown in FIG. 9 along a C-C direction.
Figure 12:
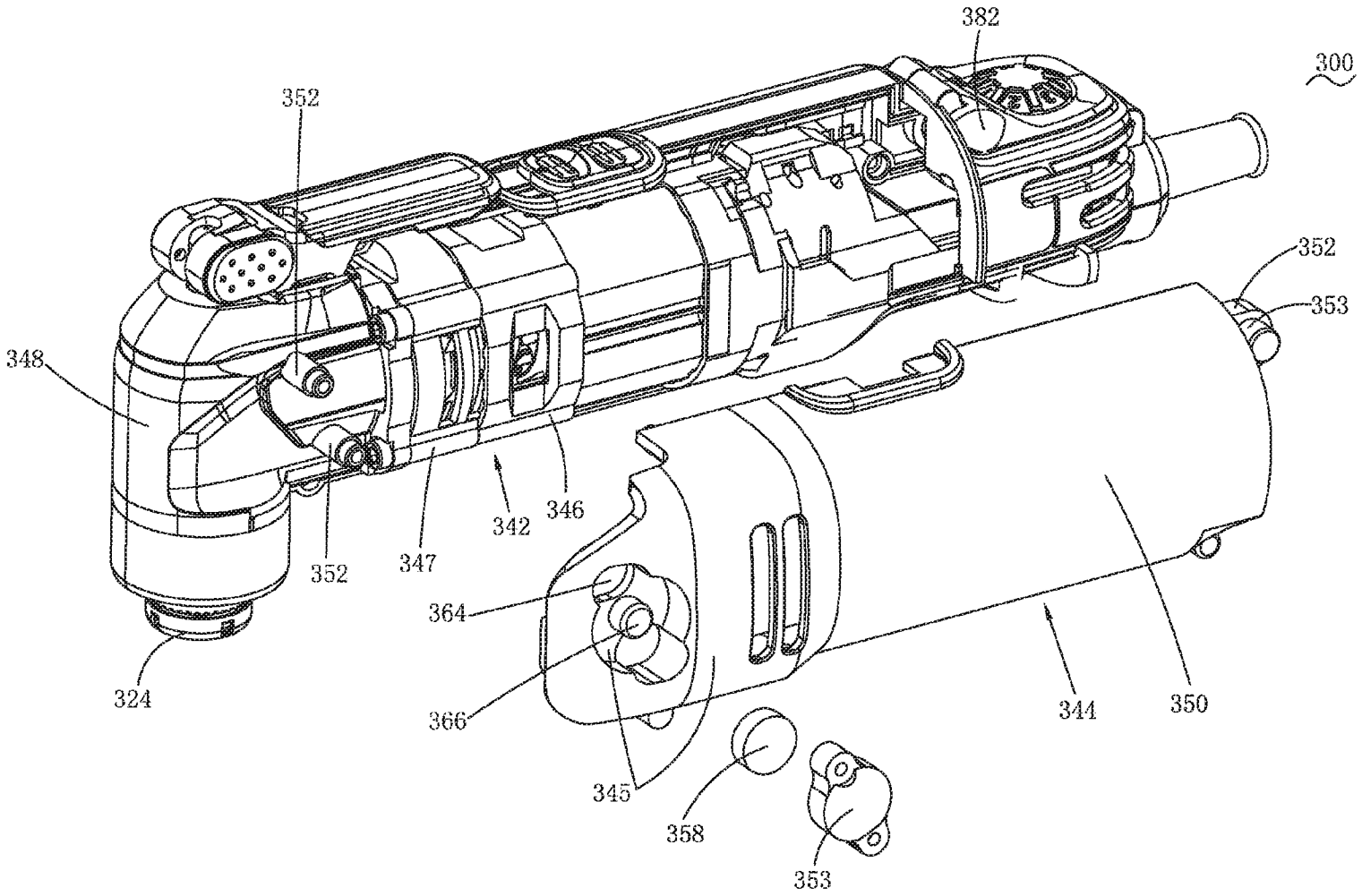
FIG. 12 is a stereoscopic exploded view of part of a structure of the power tool as shown in FIG. 9.

In combination with FIG. 10, FIG. 11 and FIG. 12, in order to reduce vibration on the holding part on the housing and improve operation comfortableness, in the present embodiment, the housing comprises an inner housing 342 and an outer housing 344 located outside the inner housing 342, and a clearance 343 exists between the inner housing 342 and the outer housing 344.

In the present embodiment, the outer housing 344 has an outer profile 345 back to the motor 320, the outer profile 345 is provided with the holding part 350, or the outer profile 345 of the outer housing 344 back to the inner housing 342 is provided with the holding part 350. An operator can operate the power tool 300 by holding the holding part 350 on the outer profile 345 of the outer housing 344, and the holding is convenient and firm.

By disposing the double-layer housing, the vibration of the motor 320 and the output shaft 322 passes by the first housing (inner housing 342) and is then transmitted to the outer housing 344 outside the inner housing 342, and the vibration transmitted to the holding part 350 on the outer profile 345 of the outer housing 344 can be reduced.

The inner housing 342 comprises a motor housing 346 used for mounting the motor 320 and a head housing 348 used for receiving part of the output shaft 322. Those skilled in the art can conceive that the inner housing 342 can also only comprise the motor housing 346 for mounting the motor 320 or only comprise the head housing 348 for receiving part of the output shaft 322.

The motor housing 346 is used for mounting the motor 320, and can be designed to partially or totally wrap the motor 320 according to needs.

The head housing 348 contains part of the output shaft 322, that is, part of the output shaft 322 is received in the head housing 348, but a free end of the output shaft 322 extends out of the head housing 348 to be conveniently matched and connected with the fixing member 324 so as to better clamp the cutting tool W between the free end of the output shaft 322 and the fixing member 324.

In the present embodiment, the inner housing 342 further comprises a middle lid 347 connected between the motor housing 346 and the head housing 348. The middle lid 347 is connected to the motor housing 346 and the head housing 348 both by screws, and the middle lid 347 is used for receiving a cooling fan driven by the motor 320. Therefore, the inner housing 342 comprises the motor housing 346, the middle lid 347 and the head housing 348 connected in sequence, such that manufacturing of the inner housing 342 becomes simple, those skilled in the art can conceive that the middle lid 347 and the motor housing 346 and/or the head housing 348 can also be disposed integrally, and all the technical solutions same as or similar to the present technical solution should fall within a protective scope of the present invention.

In order to further reduce the vibration, the power tool 300 of the present embodiment is also provided with a vibrating body.

Similar to the first embodiment, the power tool of the present embodiment also has a head housing vibration damping solution and a motor housing vibration damping solution. But the head housing vibration damping solution of the present embodiment is to externally dispose the vibration damping element on the outer profile of the head housing of the outer housing corresponding to the inner housing; and the motor housing vibration damping solution of the present embodiment still is to dispose the vibration damping element in the internal receiving space of the motor housing.

The head housing vibration damping solution of the present embodiment is described at first.

In the present technical solution, a plane where the axis Y of the output shaft 22 is positioned is defined as a middle plane, one vibration damping element is disposed on each of two sides of the middle plane respectively, and the two vibration damping elements are symmetric about the middle plane and mounting structures are the same. Preferably, the two vibration damping elements are symmetrically disposed relative to the middle plane parallel with the axis X of the motor shaft 26 and the mounting structures are the same. More preferably, the axis X of the motor shaft 26 and the axis Y of the output shaft 22 are coplanar, and the two vibration damping elements are symmetrically disposed relative to a central plane determined by the axis X of the motor shaft 26 and the axis Y of the output shaft 22 and the mounting structures are the same. One vibration damping element and its mounting structure are described in detail hereinafter.

In the technical solution, the outer housing 344 is equivalent to the first housing, the inner housing 342 is equivalent to the second housing, the first housing (outer housing 344) has a first side back to the second housing (inner housing 342), the first side is provided with a supporting member, the second housing (inner housing 342) is provided with a connecting unit, the connecting unit has an abutting member located on the first side, a vibration damping device is disposed between the supporting member and the abutting member, and here, the vibration damping device comprises a vibration damping element. While in the present technical solution, the first side of the first housing (outer housing 344) back to the second housing (inner housing 342) comprises an outer profile 345 and an external space disposed outside the outer profile 345.

In combination with FIG. 11 and FIG. 12, the outer housing 344 is provided with a through hole 364, and the clearance 343 between the inner housing 342 and the outer housing 344 is communicated with the outer profile 345 of the outer housing 344 through the through hole 364.

The inner housing 342 is provided with a connecting unit, the connecting unit comprises a connector 352 connected to the inner housing 342 and an the abutting member 353 connected to the connector 352, the connector 352 penetrates through the through hole 364 to extend out of the outer profile 345, the outer profile 345 of the outer housing 344 has a contact surface 356, the abutting member 353 is located outside the outer profile 345 and has an abutting surface 354 opposite to the contact surface 356, a force transmission member 358 is disposed between the contact surface 356 and the abutting surface 354, the force transmission member 358 can be elastically deformed to resist an internal friction force caused by damping, and in other words, the force transmission member 358 is a vibration damping element.

The connecting unit provided with the abutting surface 354 is connected to the inner housing 342, while the contact surface 356 is disposed on the outer profile 345 of the outer housing 344, therefore, the force transmission member 358 which can be elastically deformed to resist the internal friction force caused by damping is disposed between the abutting surface 354 and the contact surface 356, which is equivalent to that the force transmission member 358 which can be elastically deformed to resist the internal friction force caused by damping is disposed between the inner housing 342 and the outer housing 344. Therefore, the force transmission member 358 can reduce movement transmitted between the inner housing 342 and the outer housing 344, for example, collision or vibration transmitted to the outer housing 344 from the inner housing 342 can be reduced, particularly, high frequency oscillation, for example, the vibration or noise transmitted to the outer housing 344 from the inner housing 342 is weakened, such that the vibration of the holding part 350 is reduced, environmental noise is reduced and operation comfortableness is improved.

The connector 352 is connected to the inner housing 342, and the connector 352 and the inner housing 342 can be two independent parts and the connector 352 is mounted on the inner housing 342. There are various mounting manners, such as screw connection or interference fit, or welding and other mounting manners. The connector 352 and the inner housing 342 can also be integrally molded. In the technical solution, the part of the inner housing 342 provided with the connector 352 is made of plastic, the connector 352 and the inner housing 342 are integrally formed, and the connector 352 is also made of plastic. Those skilled in the art can conceive that except for the plastic, the connector 352 can also be made of a metal material, for example, aluminum alloy to improve the strength and service life.

According to the present technical solution, preferably, the connector 352 longitudinally extends, and its longitudinally extending direction is approximately vertical to the extending direction of the inner housing 342. Preferably, the longitudinally extending direction of the connector 352 is simultaneously vertical to the axis X of the motor 320 and the axis Y of the output shaft 322, that is, the longitudinally extending direction of the connector 352 is vertical to the central plane XY.

The abutting member 353 is connected to the connector 352. In the present technical solution, since the abutting member 353 is provided with the abutting surface 354, a cross section of the abutting member 353 in a direction approximately parallel with the central plane XY is larger than the cross section of the connector 352, and the cross section of the abutting member 353 in a direction approximately parallel with the central plane XY is larger than the cross section of the through hole 364. Therefore, in order to facilitate mounting, in the present technical solution, the abutting member 353 and the connector 352 are two separate parts and are mounted together. The mounting manner of the present technical solution is screw (not shown) connection, and those skilled in the art can conceive that other mounting manners, for example, interference fit or welding can also be used. In the present technical solution, the connector 352 is made of plastic, and those skilled in the art can conceive that except for the plastic, the abutting member 353 can also be made of a metal material, for example, aluminum alloy to improve the strength and service life.

According to the present technical solution, preferably, the number of the connectors 352 is two, the two connectors 352 can be disposed by separated by certain distance, and the abutting member 353 is connected to the two connectors 352. Preferably, the two connectors 352 are connected to the edge of the abutting member 353, and the mounting stability of the abutting member 353 can be improved, so that use reliability of the whole machine is improved.

Those skilled in the art can conceive of disposing only one connector, the connector is connected to the middle of the abutting member, and all technical solutions same as or similar to the present technical solution should fall within a protective scope of the present technical solution.

Those skilled in the art can appreciate that all connectors 352 connected to one abutting member 353 can be regarded as one group. In the present technical solution, this group of connectors 352 are connected to the head housing 348 of the inner housing 342, and those skilled in the art can conceive that this group of connectors 352 can also be connected to the motor housing 346 of the inner housing 342; or part of this group of connectors 352 are connected to the head housing 348 and part of this group of connectors 352 are connected to the motor housing 346; or two or more groups of connectors 352 are disposed, one or more groups of connectors 352 are connected to the head housing 348 of the inner housing 342, and one or more groups of connectors 352 are connected to the motor housing 346 of the inner housing 342.

In the present embodiment, one connecting unit comprises two connectors 352 and one abutting member 353. The number of the connecting units is two, the two connecting units are connected to the head housing 348 of the inner housing 342 and are symmetrically disposed relative to the axis Y of the output shaft 322, and preferably, are symmetrically disposed relative to the central plane determined by the axis of the motor and the axis of the output shaft.

The outer housing 344 is provided with a through hole 364, which enables the clearance 343 between the inner housing 342 and the outer housing 344 to be communicated with the outer profile 345 of the outer housing 344. The through hole 364 also enables the connector 352 to penetrate through the through hole 364 to extend out of the outer profile 345 of the outer housing 344.

In the technical solution, the clearance exists between the connector 352 and the through hole 364. After the connector 352 penetrates through the through hole 364 and is connected to the abutting member 353, the clearance between the connector 352 and the through hole 364 enables the connector 352 and the through hole 364 to not contacting always, such that the inner housing 342 connected to the connector 352 and the outer housing 344 provided with the through hole 364 would not contact each other, the vibration is prevented from being directly transmitted to the outer housing 344 from the inner housing 342, therefore, the vibration is reduced and operation comfortableness is improved.

The outer profile 345 of the outer housing 344 has a contact surface 356, in the present technical solution, the outer profile 345 of the outer housing 344 is provided with a supporting member 366, and the contact surface 356 is disposed on the supporting member 366. According to the present technical solution, preferably, the part of the outer profile 345 of the outer housing 344 provided with the supporting member 366 is concave inwards along a direction toward the inner housing 342 relative to the outer profile 345 of other parts of the outer housing 344, such that after the abutting member 353 is connected to the connector 352, a height difference between the outer surface of the abutting member 353 and the outer profile 345 of the other parts of the outer housing 344 is smaller, therefore, the whole power tool 300 is regular in appearance and attractive in modeling.

Therefore, after the abutting member 353 and the connector 352 are connected, the abutting member 353 is located outside the contact surface 356 of the outer housing 344 and has an abutting surface 354 opposite to the contact surface 356, so that the force transmission member 358 is conveniently mounted between the abutting surface 354 and the contact surface 356.

The force transmission member 358 enables a predetermined minimal interval to be kept between the abutting surface 354 and the contact surface 356, in this way, the clearance 343 always exists between the inner housing 342 and the outer housing 344, the inner housing 342 and the outer housing 344 do not contacting all the time, and the vibration is prevented from being directly transmitted to the outer housing 344 from the inner housing 342, such that the vibration of the holding part 350 is reduced, and operation comfortableness is improved.

In the present technical solution, the supporting member 366 longitudinally extends, and its longitudinally extending direction is approximately vertical to the outer housing 344. Preferably, the longitudinally extending direction of the supporting member 366 is simultaneously vertical to the axis X of the motor 320 and the axis Y of the output shaft 322, that is, the longitudinally extending direction of the supporting member 366 is vertical to the central plane XY formed by the axis X of the motor and the axis Y of the output shaft 22. According to the present technical solution, more preferably, the longitudinally extending direction of the supporting member 366 is parallel with that of the connector 352.

The supporting member 366 longitudinally extends to protrude out of the outer profile 345 of the outer housing 344, and correspondingly, the abutting surface 354 of the abutting member 353 is concave along a direction away from the outer housing 344.

After the force transmission member 358 is mounted between the supporting member 366 and the abutting member 353, the force transmission member 358 wraps part of the supporting member 366 and is partially received in the concave abutting member 353. By such disposing manner, the force transmission member 358 not only makes contact with the end surface of the supporting member 366 but also makes contact with part of the longitudinally extending peripheral surface of the supporting member 366, and the peripheral surface is adjacent to the end surface. Therefore, the force transmission member 358 not only can reduce the vibration of the supporting member 366 in the axial direction but also can reduce the vibration of the supporting member 366 in the peripheral direction.

The vibration of the oscillating power tool is maximal in the direction parallel with a oscillating plane S formed by oscillating of the cutting tool along with the output shaft 322, therefore, according to the present technical solution, preferably, a main action force direction of the force transmission member 358 is parallel with the oscillating plane S and is vertical to the axis X of the motor 320, and the vibration transmitted to the outer housing 344 from the inner housing 342 can be reduced to the greatest extent.

The axial direction of the supporting member 366 is vertical to the central plane XY formed by the axis X of the motor and the axis Y of the output shaft 22, while the oscillating plane S formed by the oscillating of the cutting tool along with the output shaft 322 is vertical to the central plane XY, that is to say, the axial direction of the supporting member 366 is parallel with the oscillating plane S and is vertical to the axis X of the motor 320. Therefore, a main action force direction of the force transmission member 358 is the axial direction of the supporting member 366.

Preferably, after being mounted between the supporting member 366 and the abutting member 353, the force transmission member 358 is compressed to generate elastic deformation to be subjected to a prestress so as to resist an internal friction force caused by damping. Preferably, the force transmission member 358 is subjected to the prestresses in respective space directions, and the prestresses in respective space directions are different. Preferably, a main action direction of the prestresses of the force transmission member 358 is parallel with the oscillating plane S formed by oscillating of the cutting tool along with the output shaft 322 and is vertical to the axis X of the motor 320.

The axial direction of the supporting member 366 is vertical to the central plane XY formed by the axis X of the motor and the axis Y of the output shaft 22, while the oscillating plane S formed by the oscillating of the cutting tool W along with the output shaft 322 is vertical to the central plane XY, that is to say, the axial direction of the supporting member 366 is parallel with the oscillating plane S and is vertical to the axis X of the motor 320. Therefore, the prestress of the force transmission member 358 is maximal in the axial direction of the supporting member 366, that is, a main action direction of the force transmission member 358 is the axial direction of the supporting member 366.

In the present embodiment, the contact surface 356 is a convex surface, the contact surface 356 is disposed on the supporting member 366, and the convex surface is an arc surface. The abutting surface 354 is a concave surface, the abutting surface 354 is disposed on the abutting member 353, and the concave surface is also an arc surface, such that the force transmission member 358 is subjected to prestress in each space direction vertical to the arc surface, and the vibration transmitted to the outer housing 344 from the inner housing 342 can be better reduced. Those skilled in the art can conceive that shapes such as plane and sphere can also be adopted expect for the arc surface, and all technical solutions same as or similar to the present technical solution should fall within a protective scope of the present invention.

In the present technical solution, the force transmission member 358 is flat-shaped under an unassembled state, and is bowl-shaped after being assembled. That is to say, the force transmission member 358 has no concave part under the unassembled state, but is compressed to be elastically deformed to form the concave part matched with the convex supporting member 366 after being assembled between the supporting member 366 and the abutting member 353. Since the force transmission member 358 is flat-shaped under the unassembled state, the force transmission member 358 is simple to manufacture. Those skilled in the art can conceive that the force transmission member 358 can also be bowl-shaped under the unassembled state, and all technical solutions same as or similar to the present technical solution should fall within a protective scope of the present invention.

The force transmission member 358 is made of an elastic material, for example a part made of PU, rubber, elastic metal and other materials, or a part made by combination of these materials, or part combination made of different single materials. Preferably, the force transmission member 358 uses honeycomb PU elastomer, whose density between 0.35-0.65 kg/dm$^3$, and preferably 0.4 kg/dm$^3$. The applicant found that such elastomer can reduce the vibration transmitted to the outer housing 344 from the inner housing 342 to the greatest extent, such that the operation comfortableness is improved to the greatest extent.

When the power tool 300 of the present technical solution is mounted, after the inner housing 342 is mounted, the connector 352 connected on the inner housing 342 is enabled to be aligned with the through hole 364 in the outer housing 344 and penetrate through the through hole 364, and the outer housing 344 sleeves the inner housing 342; afterwards, the force transmission member 358 is received in the concave abutting member 353; finally, the abutting member 353 and the connector 352 are connected by screws (not shown). Thus it can be known that the power tool 300 of the present technical solution is convenient and rapid to mount, the force transmission member 358 is mounted on the outer surface of the outer housing 344, the mounting visibility is good and the mounting is more convenient and rapid.

Figure 13:
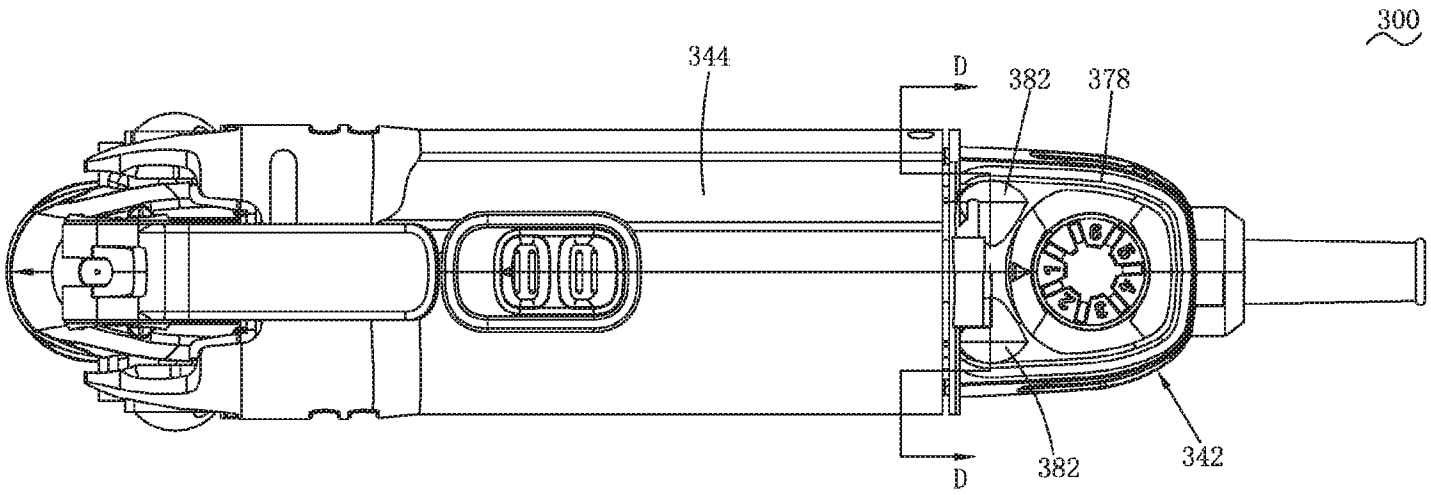
FIG. 13 is a top view of the power tool as shown in FIG. 9.
Figure 14:
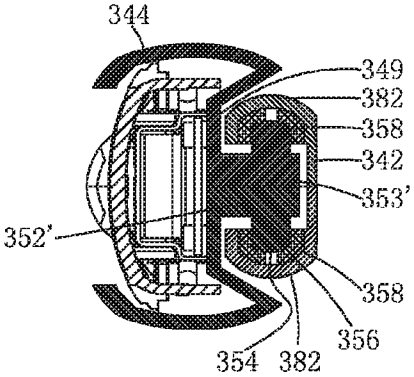
FIG. 14 is a section schematic diagram of the power tool as shown in FIG. 13 along a D-D direction.
Figure 15:
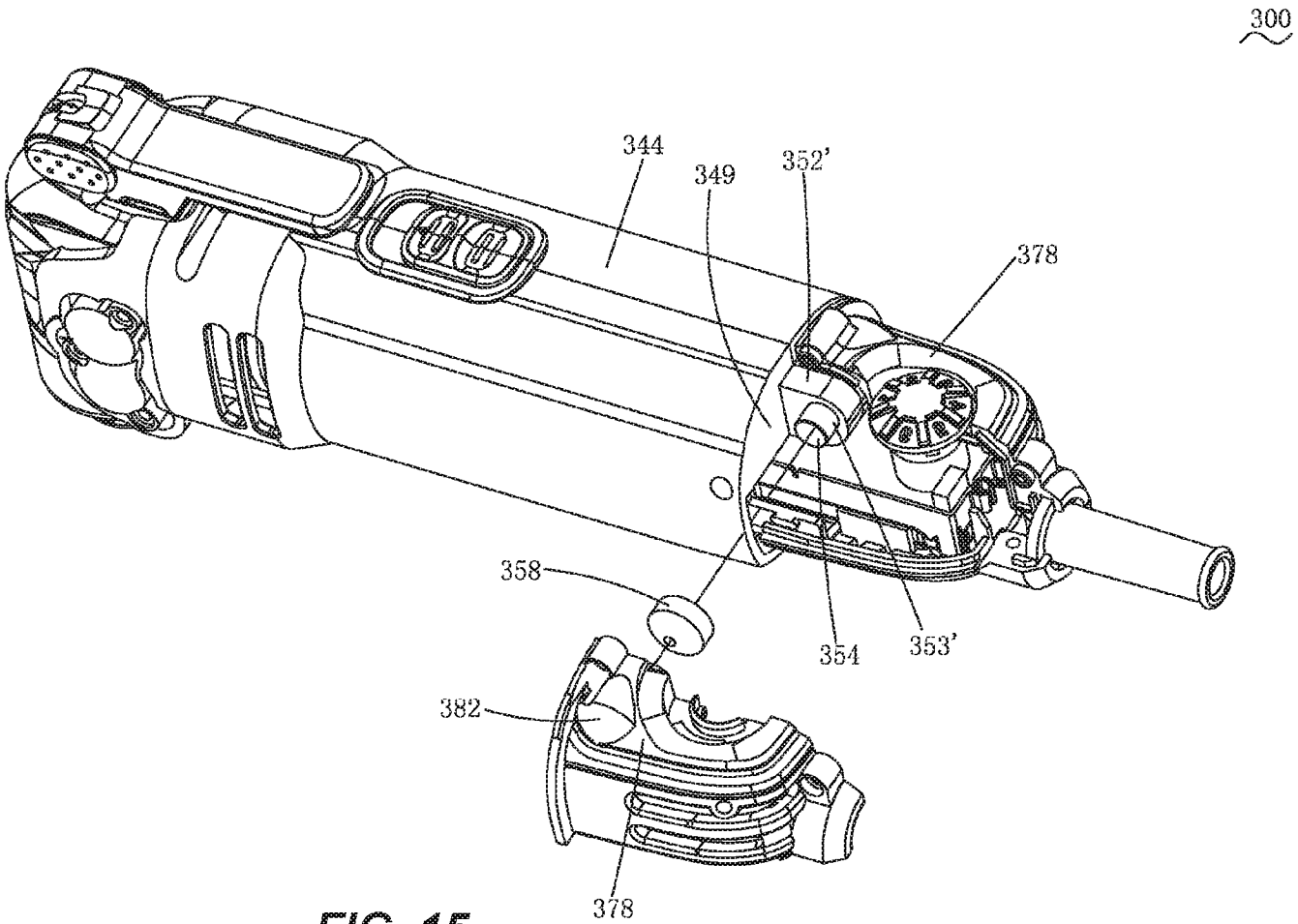
FIG. 15 is an exploded schematic diagram of a mounting structure for a vibration damping element on the tail of the power tool as shown in FIG. 13.

FIG. 13 to FIG. 15 show a motor housing vibration damping solution of the power tool of the present embodiment.

In order to make the specification concise, the main difference between the motor housing vibration damping solution of the present embodiment and the motor housing vibration damping solution of the power tool of the first embodiment as well as important features are mainly described hereinafter.

In the present technical solution, the inner housing 342 is equivalent to the first housing, the outer housing 344 is equivalent to the second housing, the first housing (inner housing 342) has a first side back to the second housing (outer housing 344), the first side is provided with a supporting member, the second housing (outer housing 344) is provided with a connecting unit, having an abutting member facing the first side, a vibration damping device is disposed between the supporting member and the abutting member, here, the vibration damping device comprises a vibration damping element. Besides, in the present technical solution, the first side of the first housing (inner housing 342) back to the second housing (outer housing 344) comprises an inner profile and an internal receiving space of the inner housing 342.

In the present technical solution, the outer housing 344 is disposed outside the inner housing 342, but an extending length of the outer housing 344 is smaller than that of the inner housing 342. Specifically, the outer housing 344 has a first end and a second end, the second end gets away from the output shaft of the power tool relative to the first end, and the inner housing 342 extends out of the second end of the outer housing 344. The second end of the outer housing 344 has an end surface 349 vertical to the motor shaft, and the connecting unit is disposed on the end surface 349. According to the present technical solution, preferably, the connecting unit is integrally formed on the outer housing. Specifically, the connecting unit comprises a connector 352' and an abutting member 353', the connector 352' is vertical to the end surface 349 and longitudinally extends along a direction away from the output shaft from the end surface 349, the abutting member 353' longitudinally extends, the middle of the abutting member 353' is connected to the end part of the connector 352' away from the output shaft, and two end surfaces of the abutting member 353' are abutting surfaces 354.

The second half housing 378 of the motor housing of the inner housing 342 comprises detachably mounted left and right half housings, the left half housing and the right half housing are respectively provided with a cylindrical receiving part 382 with one closed end, and after the left half housing and the right half housing are mounted, a space encircled by the two cylindrical receiving parts 382 is part of the internal receiving space of the motor housing. The two contact surfaces 356 are respectively parts of the inner profiles of the close ends of the two cylindrical receiving parts 382.

The two force transmission members 358 are respectively abutted between the abutting surface 354 and the contact surface 356 opposite to each other.

Fifth Embodiment

Figure 16:
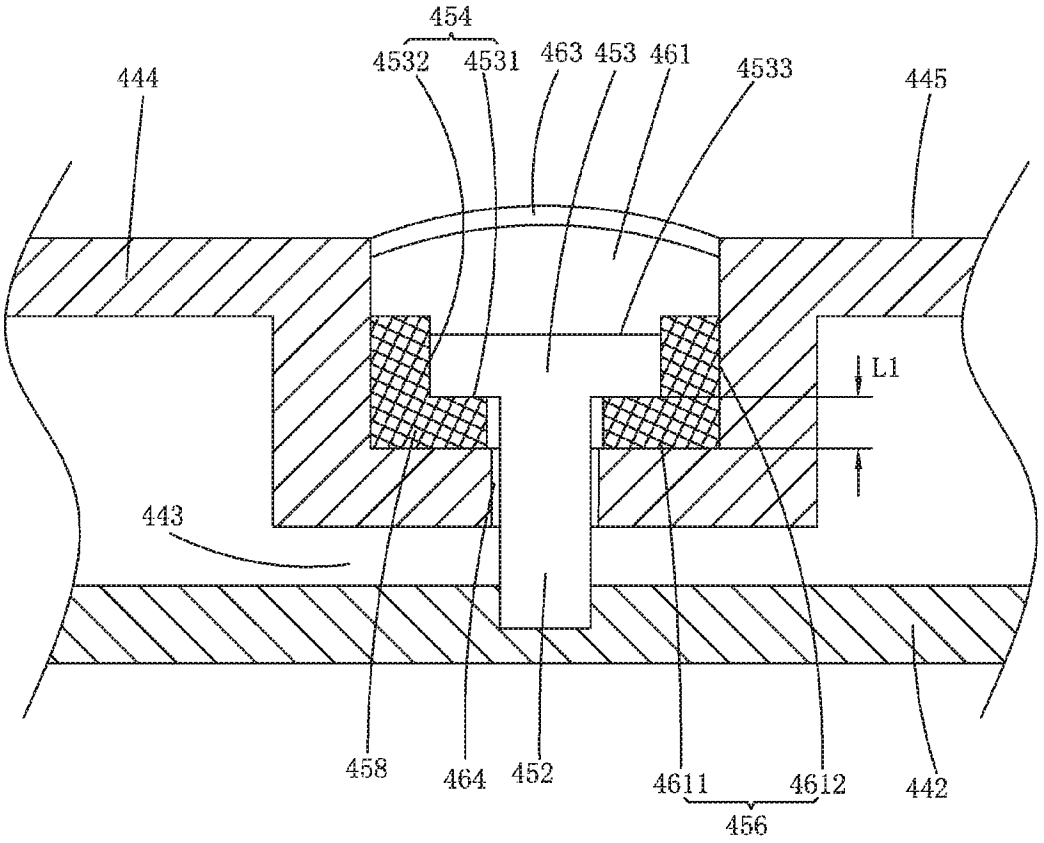
FIG. 16 is a simplified schematic diagram of a vibration damping structure of a power tool provided by a fifth embodiment of the present invention.

FIG. 16 simply shows a power tool vibration damping structure provided by a fifth embodiment of the present invention.

Referring to FIG. 16, similar to the head housing vibration damping solution of the fourth embodiment, the power tool comprises an inner housing 442 and an outer housing 444 located outside the inner housing 442, a clearance 443 exists between the inner housing 442 and the outer housing 444, the outer housing 444 has an outer profile 445 back to the inner housing 442, the outer housing 444 is provided with a through hole 464, the clearance 443 is communicated with the outer profile 445 by the through hole 464, the inner housing 442 is provided with a connecting unit, which comprises a connector 452 connected to the inner housing 442 and an abutting member 453 connected to the connector 452, the connector 452 penetrates through the through hole 464 to extend out of the outer profile 445, the outer profile 445 has a contact surface 456, the abutting member 453 is located outside the outer profile 445 and has an abutting surface 454 opposite to the contact surface 456, a force transmission member 458 is disposed between the contact surface 456 and the abutting surface 454, and the force transmission member 458 can be elastically deformed to resist an internal friction force caused by damping. Therefore, the vibration transmitted to the outer housing 444 from the inner housing 442 is reduced.

In order to make the specification concise, the main difference between the power tool of the present embodiment and the head housing vibration damping solution of the power tool of the fourth embodiment as well as important features are mainly described hereinafter.

In the present embodiment, the number of the connector 452 of the connecting unit is one, the connector 452 is connected to the middle of the abutting member 453, and preferably, the connector 452 and the abutting member 453 are integrally formed. The connector 452 penetrates through the through hole 464 of the outer housing 444 to be in interference fit with the inner housing 442.

In the present embodiment, the outer profile 445 of the outer housing 444 is provided with a concave part 461, and the concave part 461 has a bottom surface 4611 and a peripheral surface 4612 encircling the periphery of the bottom surface 4611 and longitudinally extending. The contact surface 456 on the outer profile 445 at least comprises the bottom surface 4611 of the concave part 461.

The abutting member 453 is received in the concave part 461 and comprises a lower surface 4531 facing the bottom surface 4611 of the concave part 461, a side surface 4532 encircling the periphery of the lower surface 4531 and adjacent to the lower surface 4531, and an upper surface 4533 adjacent to the side surface 4532 and away from the inner housing 442. The abutting surface 454 on the abutting member 453 at least comprises a lower surface 4531.

The force transmission member 458 is disposed between the contact surface 456 and the abutting surface 454, and the force transmission member 458 can be elastically deformed to resist the internal friction force caused by damping.

The abutting member 453 provided with the abutting surface 454 is connected to the inner housing 442 by a connector 452, while the contact surface 456 is disposed on the outer profile 445 of the outer housing 444, therefore, the force transmission member 458 is disposed between the abutting surface 454 and the contact surface 456, which is equivalent to that the force transmission member 458 is disposed between the inner housing 442 and the outer housing 444. Therefore, the force transmission member 458 can reduce the vibration transmitted to the outer housing 444 from the inner housing 442, such that the vibration of the holding part is reduced and operation comfortableness is improved.

Similar to the first embodiment, the force transmission member 458 enables a predetermined minimal interval L1 to be kept between the abutting surface 454 and the contact surface 456, it can be ensured that the inner housing 442 does not contacting with the outer housing 444, such that direct transmission of the vibration from the inner housing 442 to the outer housing 444 is avoided.

In the present embodiment, the bottom surface 4611 of the concave part 461 and the lower surface 4531 of the abutting member 453 are both planes, the force transmission member 458 is abutted between the planar concave bottom surface 4611 and the lower surface 4531 of the abutting member, and the structure is simple.

In the present embodiment, the side surface 4532 of the abutting member 453 is separated from the peripheral surface 4612 of the concave part 461 by certain distance. After being assembled, the force transmission member 458 is abutted against both the side surface 4532 of the abutting member 453 and the peripheral surface 4612 of the concave part 461. That is to say, the abutting surface 454 not only comprises the lower surface 4531 of the abutting member 453 but also comprises the side surface 4532 adjacent to the lower surface 4531; and the contact surface 456 not only comprises the bottom surface 4611 of the concave part 461 but also comprises part of the peripheral surface 4612 encircling the bottom surface 4611.

By this disposing manner, not only is the vibration in an axial direction of the connector 452 reduced, but also the vibration in a direction vertical to the axial direction of the connector 452 can be reduced. Those skilled in the art can conceive that after being assembled, the force transmission member 458 can also be only abutted against the lower surface 4531 of the abutting member 453 and the bottom surface 4611 of the concave part 461.

After being assembled, the force transmission member 458 is clamped between the lower surface 4531 and side surface 4532 of the abutting member 453 and the bottom surface 4611 and part of the peripheral surface 4612 of the concave part 461, that is, the force transmission member 458 is bowl-shaped after being assembled. Similar to the former embodiment, the force transmission member 458 is bowl-shaped under an unassembled state, and can also be flat-shaped under the unassembled state and is bowl-shaped only after being assembled.

In the present embodiment, in the longitudinally extending direction of the connector 452, the upper surface 4533 of the abutting member 453 is close to the inner housing 442 relative to the top end opening of the peripheral surface 4612 of the concave part 461, such that the abutting member 453 is totally received in the concave part 461, and the top end opening of the peripheral surface 4612 of the concave part 461 is disposed on a dustproof lid 463. A height difference between the dustproof lid 463 and the outer profile 445 on the periphery of the concave part 461 of the outer housing 444 is small, not only are the connecting unit and the force transmission member 458 protected, but also the power tool is regular in appearance and attractive in modeling.

Those skilled in the art can conceive that by reasonably disposing the longitudinal length of the peripheral surface 4612 of the concave part 461, the upper surface 4533 of the abutting member 453 is approximately equal to the outer profile 445 on the periphery of the concave part 461 of the outer housing 444 in height, and all technical solutions same as or similar to the present technical solution should fall within a protective scope of the present invention.

Sixth Embodiment

FIG. 17 to FIG. 20 show a power tool 500 provided by a sixth embodiment of the present invention.

The power tool 500 of the present embodiment is relatively similar to the power tool 300 of the fourth embodiment in structure, in order to make the specification concise, the main difference between the power tool 500 of the present embodiment and the power tool 300 of the fourth embodiment as well as important features are mainly described hereinafter.

Figure 17:
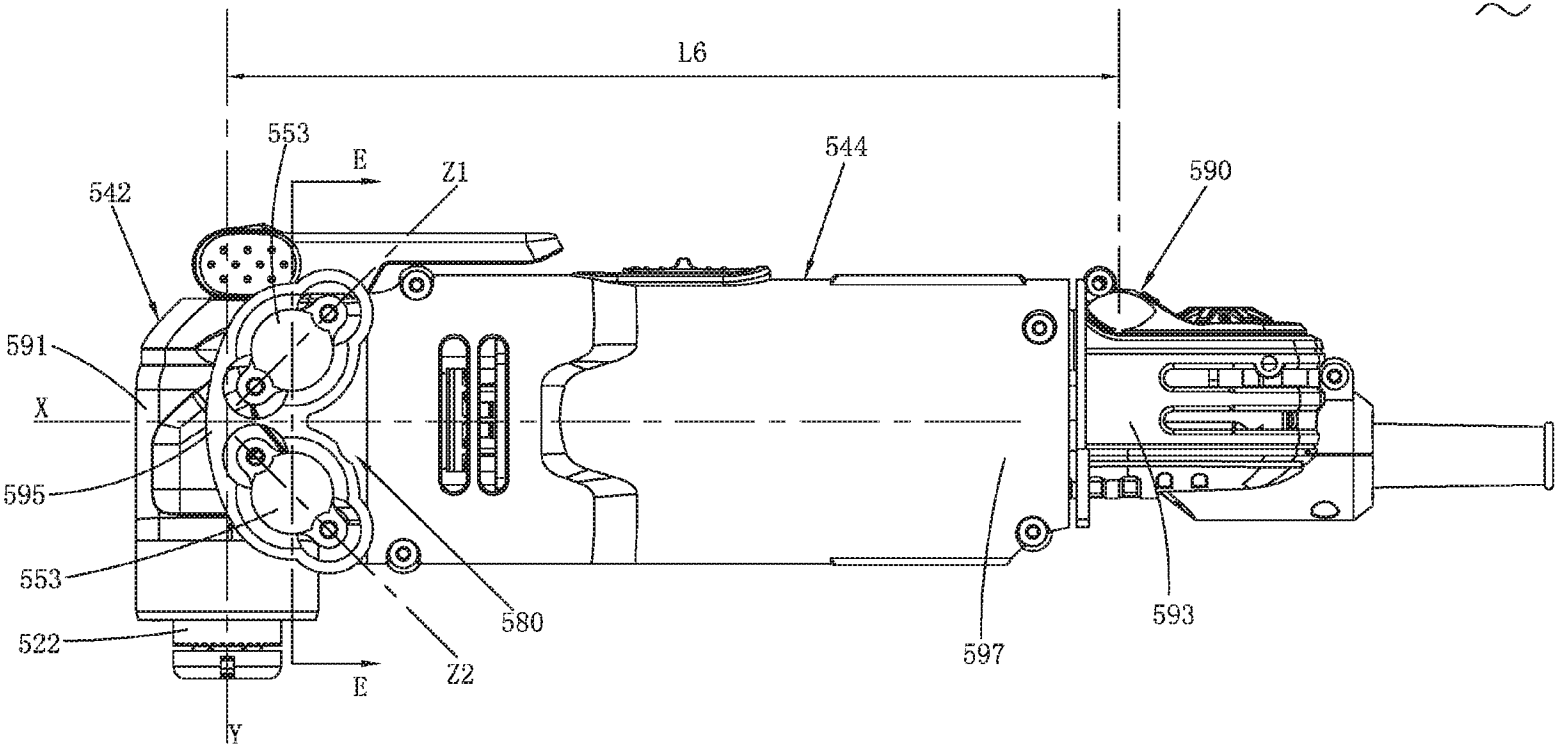
FIG. 17 is a main view of a power tool provided by a sixth embodiment of the present invention.
Figure 18:
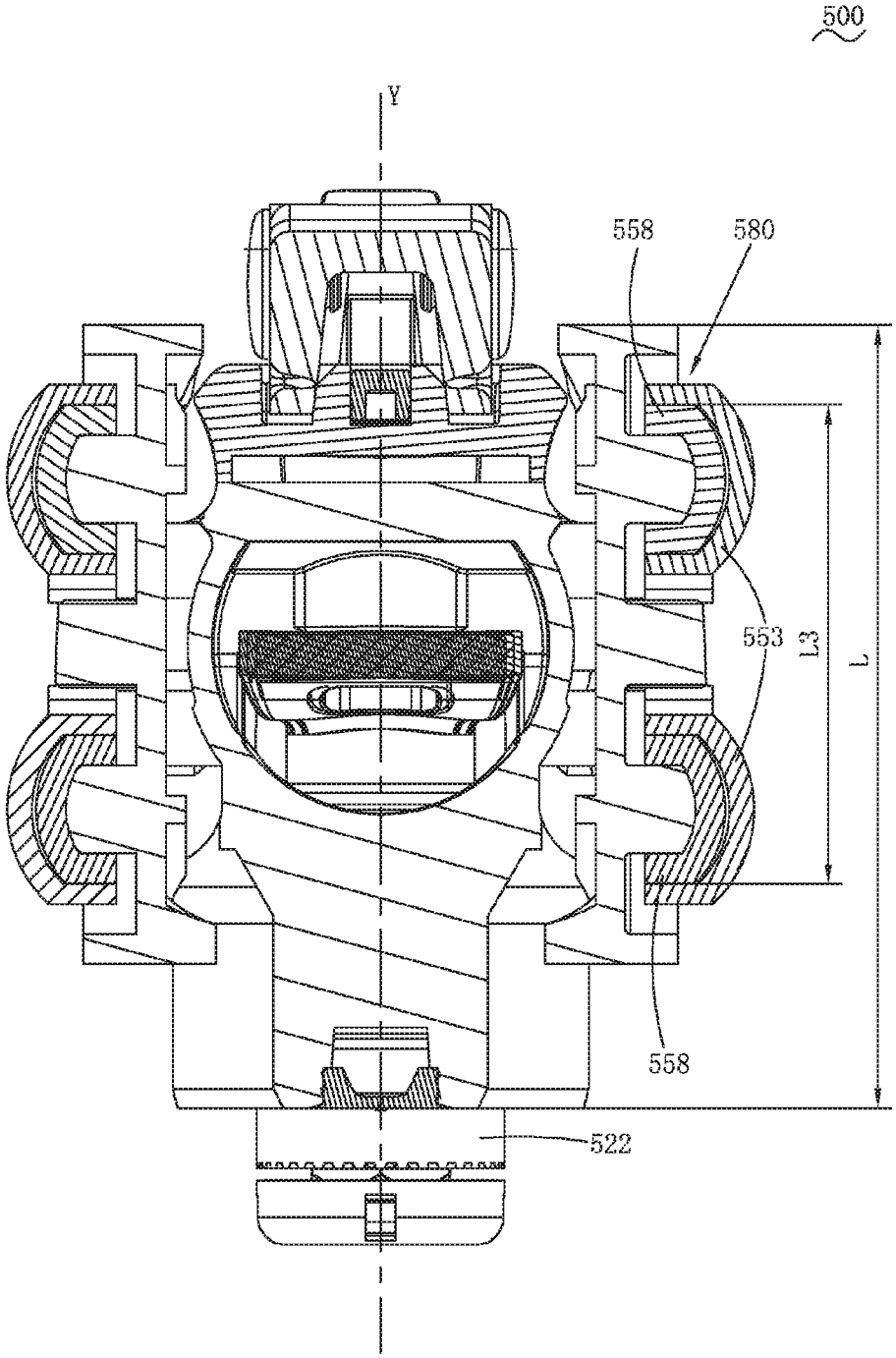
FIG. 18 is a section schematic diagram of the power tool as shown in FIG. 17 along an E-E direction.

Referring to FIG. 17 and FIG. 18, same as the fourth embodiment, the housing of the power tool 500 of the present embodiment comprises an inner housing 542 and an outer housing 544 located outside the inner housing 542, a clearance exists between the inner housing 542 and the outer housing 544, and N vibration damping elements 558 are disposed between the inner housing 542 and the outer housing 544 to reduce the vibration transmitted to the outer housing 544 from the inner housing 542.

Same as the fourth embodiment, the inner housing 542 of the present embodiment comprises a first head housing 591 for receiving part of an output shaft 522 and a first motor housing 593 for receiving at least part of the motor. The outer housing 544 comprises a second head housing 595 located outside the first head housing 591, and a clearance exists between the first head housing 591 and the second head housing 595. The outer housing 544 further comprises a second motor housing 597 located outside the first motor housing 593, and a clearance exists between the first motor housing 593 and the second motor housing 597.

Same as the fourth embodiment, the power tool 500 of the present embodiment has a head housing vibration damping solution, that is, a head housing vibration damping device 580 is disposed between the first head housing 591 and the second head housing 595. The power tool 500 of the present embodiment also has a motor housing vibration damping solution, that is, a motor housing vibration damping device 590 is disposed between the first motor housing 593 and the second motor housing 597.

The plane where the axis Y of the output shaft 522 is positioned is of a middle plane. The head housing vibration damping device is disposed on at least one side of the middle plane. Preferably, the middle plane is parallel with the axis X of the motor shaft (not shown). Preferably, the axis X of the motor shaft and the axis Y of the output shaft 522 are coplanar and form a central plane XY, and the head housing vibration damping devices 580 are symmetrically disposed on both sides of the central plane XY. Preferably, the head housing vibration damping devices 580 on both sides of the central plane have the same number and mounting structures. In the present embodiment, the head housing vibration damping devices 580 are symmetrically disposed on both sides of the central plane.

The motor housing vibration damping device is disposed on at least one side of the middle plane. Preferably, the middle plane is parallel with the axis X of the motor shaft (not shown). Preferably, the axis X of the motor shaft and the axis Y of the output shaft 522 are coplanar to form the central plane XY, and the motor housing vibration damping devices 590 are symmetrically disposed on both sides of the central plane XY. Preferably, the motor housing vibration damping devices 590 on both sides of the central plane have the same number and mounting structures. In the present embodiment, the motor housing vibration damping devices 590 are symmetrically disposed on both sides of the central plane.

The head housing vibration damping solution on one side of the middle plane is described at first hereinafter.

Referring to FIG. 17 and FIG. 18, the head housing vibration damping solution of the power tool 500 of the present embodiment mainly differs from the head housing vibration damping solution of the power tool 300 of the fourth embodiment in: in the head housing vibration damping solution of the fourth embodiment, the head housing vibration damping device only comprises one vibration damping element; and in the head housing vibration damping solution of the present embodiment, the head housing vibration damping device 580 comprises two vibration damping elements 558.

In the present technical solution, each vibration damping element 558 and its mounting structure are same as those in the head housing vibration damping solution of the fourth embodiment and are not repeated here.

The head housing vibration damping device 580 of the present technical solution comprises two vibration damping elements 558, and an extending length of the head housing vibration damping device 580 along the axial direction of the output shaft 522 is larger than that along a radial direction of the output shaft 522. Therefore, the head housing vibration damping device 580 longitudinally extends along the direction of the output shaft 522, further the head housing vibration damping device 580 has stronger support for the first head housing 591 and the second head housing 595 in certain range in the axial direction of the output shaft 522, and relative movement between the first head housing 591 and the second head housing 595 can be obviously reduced, such that reduction of working efficiency of the cutting tool caused by a fact that the relative movement between the first head housing 591 and the second head housing 595 offsets part of an oscillating angle of the cutting tool is avoided.

In the present embodiment, the head housing vibration damping device 580 comprises two vibration damping elements, and each vibration damping element comprises a vibration damping part contacting with the first head housing 591 and the second head housing 595. An extending length of the head housing vibration damping device 580 along the axial direction of the output shaft 522 is larger than that along the radial direction of the output shaft 522. It can be understood that a distance (L3) between two furthest points of the two vibration damping parts along an axial direction of the output shaft 522 is larger than the distance between the two furthest points along a radial direction of the output shaft 522. That is to say, a span of the two vibration damping parts along the axial direction of the output shaft 522 is larger than that along the radial direction of the output shaft 522. Of course, the number of the vibration damping elements can be N, wherein the distance (L3) between two furthest points of the N vibration damping parts along an axial direction of the output shaft 522 is larger than the distance between the two furthest points along a radial direction of the output shaft 522, and a span of the N vibration damping parts along the axial direction of the output shaft 522 is larger than that along the radial direction of the output shaft 522.

Figure 20:
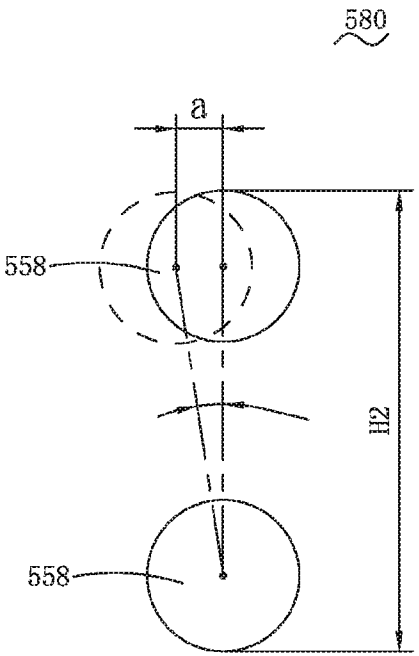
FIG. 19 and FIG. 20 are simplified schematic diagrams of vibration damping principle analysis of the power tool as shown in FIG. 17.
Figure 19:
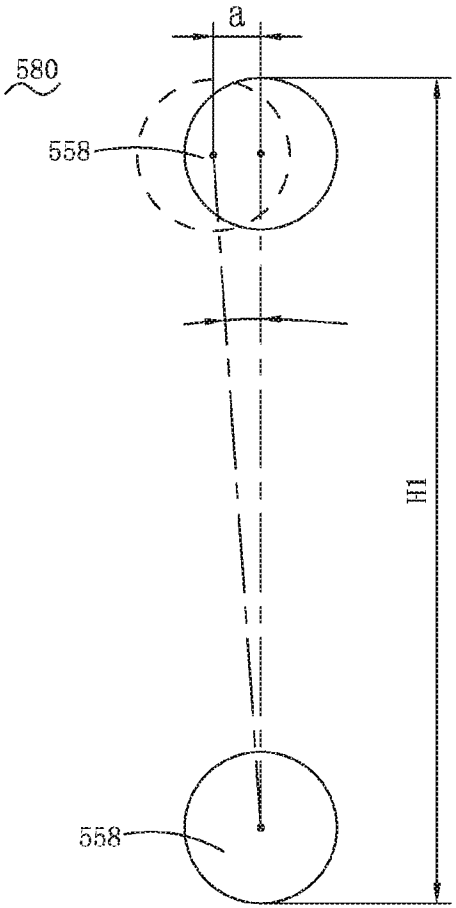

Of course, the larger the span in the axial direction of the output shaft 522 is, the better a vibration damping effect is, and FIG. 19 and FIG. 20 are combined for explanation hereinafter. In a case that other conditions are the same, in FIG. 19, each of the two vibration damping elements 558 of the head housing vibration damping device 580 comprises a vibration damping part contacting with the first head housing 591 and the second head housing 595, and a distance between two furthest points along the axial direction of the output shaft is H1; in FIG. 20, the distance between the two furthest points of the vibration damping parts, contacting with the first head housing 591 and the second head housing 595, of the two vibration damping elements 558 of the head housing vibration damping device 580 along the axial direction of the output shaft is H2, wherein H1>H2. In order to simplify an analysis process, assuming that in a working process of the power tool, one of the vibration damping elements 558 (the lower side vibration damping element 558 in the drawing) of the head housing vibration damping device 580 is kept still, and the other vibration damping element 558 (the upper side vibration damping element 558 in the drawing) is compressed to cause the vibration damping element 558 to move to the position shown by a virtual line from the position shown by a solid line to generate deformation a. When the same deformation a is generated in FIG. 19 and FIG. 20, a movement angle of the upper side vibration damping element 558 relative to the lower side vibration damping element 558 in FIG. 19 is O1, and the movement angle of the upper side vibration damping element 558 relative to the lower side vibration damping element 558 in FIG. 20 is O2, since H1>H2, obviously, O1<O2. That is to say, the two vibration damping elements 558 with larger distance in FIG. 19 enable the movement angle of the first head housing 591 relative to the second head housing 595 to be smaller, and the working efficiency is relatively higher; the two vibration damping elements 558 with smaller distance in FIG. 20 enable the movement angle of the first head housing 591 relative to the second head housing 595 to be larger, and the working efficiency is relatively poorer. That is, the larger the distance between the two vibration damping elements 558 along the direction of the output shaft is, the longer an extending length of the head housing vibration damping device 580 along the direction of the output shaft is, and the better the working efficiency is.

Relative to the power tool without the vibration damping element, the power tool of the present technical solution has better vibration damping effect since the vibration damping element is disposed. The power tool whose head housing vibration damping device comprises two vibration damping elements in the present technical solution is better than the power tool whose head housing vibration damping device only comprises one vibration damping element in working efficiency.

The extending length of the head housing vibration damping device 580 along the direction of the output shaft 522 is the distance between two furthest points on the two vibration damping elements 558 along the direction of the output shaft 522. In other words, the extending length of the head housing vibration damping device 580 along the direction of the output shaft 522 is the distance between the two furthest points of the vibration damping parts, contacting with the first head housing 591 and the second head housing 595, of the head housing vibration damping device 580 along the axial direction of the output shaft. In FIG. 18, the distance between the two furthest points of the two vibration damping parts in the head housing vibration damping device 580 along the axial direction of the output shaft 522 is L3. Under the condition of an allowed space, the larger the extending length of the head housing vibration damping device 580 along the output shaft 522 is, the better the balance between the vibration damping effect and the working efficiency is.

According to the technical solution, preferably, a maximal length of the first head housing for receiving part of the output shaft 522 along the direction of the output shaft is L, a distance L3 between the two furthest points of the two vibration damping parts, contacting with the first head housing 591 and the second head housing 595, of the two vibration damping elements along the axial direction of the output shaft 522 is larger than or equal to 0.2L and smaller than or equal to L. Preferably, the maximal length L3 of the vibration damping parts, contacting with the first head housing 591 and the second head housing 595, of the head housing vibration damping device 580 along the direction of the output shaft is larger than or equal to 0.4L and smaller than or equal to 0.7L. Reduction of the working efficiency of the output shaft 522 is avoided to the greatest extent, and sizes of the first head housing 591 and the second head housing 595 are not increased obviously.

Of course, a sum of the lengths of the two vibration damping parts along the axial direction of the output shaft 522 is larger than or equal to 0.2L and smaller than or equal to L. The effects of good vibration damping effect and high working efficiency can also be achieved. Of course, it can be appreciated by those skilled in the art that the number of the vibration damping elements can be N, and the sum of the lengths of the N vibration damping parts along the axial direction of the output shaft 522 is larger than or equal to 0.2L and smaller than or equal to L.

In the present technical solution, preferably, an extending length of the head housing vibration damping device 580 along the direction of the output shaft 522 is larger than or equal to 15 mm and smaller than or equal to 75 mm. Reduction of the working efficiency of the output shaft 522 is avoided to the greatest extent, and sizes of the first head housing 591 and the second head housing 595 are not increased obviously. Preferably, the extending length of the head housing vibration damping device 580 along the direction of the output shaft 522 is larger than or equal to 20 mm.

Here, the extending length of the head housing vibration damping device 580 along the direction of the output shaft 522 can be understood as that the sum of the lengths of the N vibration damping parts along the axial direction of the output shaft is larger than or equal to 15 mm. Or, the distance between the two furthest points of the N vibration damping parts along the axial direction of the output shaft is larger than or equal to 15 mm.

In the present embodiment, the two vibration damping elements 558 are aligned along the axial direction of the output shaft 522, that is, a connecting line between the central points of the two vibration damping elements 558 is a linear segment, and the linear segment and the output shaft 522 are parallel. Those skilled in the art can conceive that the two vibration damping elements 558 can also be disposed in a stagger manner along the axial direction of the output shaft 522, that is, the connecting line between the central points of the two vibration damping elements 558 is a linear segment, the linear segment and the output shaft 522 are at an angle, and reduction of the working efficiency of the output shaft 522 can be better avoided as long as the extending length of the two vibration damping elements 558 along the direction of the output shaft 522 is larger than that along the direction of the motor shaft.

The head housing vibration damping device 580 of the present embodiment comprises two vibration damping elements 558, compared with the head housing that is provided with only one vibration damping element of the fourth embodiment, the extending length of the vibration damping parts, contacting with the first head housing 591 and the second head housing 595, of the two vibration damping elements 558 is also increased, both the first head housing 591 and the second head housing 595 are supported in a range of the extending length of the vibration damping parts, contacting with the first head housing 591 and the second head housing 595, of the two vibration damping elements 558, and reduction of the working efficiency is avoided.

Particularly, the extending length of the vibration damping parts, contacting with the first head housing 591 and the second head housing 595, of the vibration damping elements 558 along the axial direction of the output shaft 522 is increased, such that not only is the number of the vibration damping elements 558 simply increased and the vibration damping effect improved, but also the head housing vibration damping device 580 supports the first head housing 591 and the second head housing 595 in certain range of the axial direction of the output shaft 522, and reduction of the working efficiency can be obviously avoided.

According to a conventional thought, the more the number of the vibration damping elements, the better. But the applicant found that it is not the case, the vibration damping effect contradicts against the working efficiency of the output shaft, and an optimal solution should consider both the vibration damping effect and the working efficiency. Specifically, the more the vibration damping elements are, the better the support action of the vibration damping elements for the inner housing and the outer housing is, but the poorer the vibration damping effect is, but the higher the support action of the vibration damping elements for the inner housing and the outer housing is, the more difficult the movement of the inner housing relative to the outer housing is, the smaller a relative movement angle between the inner housing and the outer housing is, the smaller a oscillating angle of the output shaft and the cutting tool offset by the relative movement is, and the higher the working efficiency of the output shaft and the cutting tool is. Under a limiting condition, when the vibration damping elements are more enough to rigidly support the inner housing and the outer housing, the support action is very strong, no relative movement exists between the inner housing and the outer housing, the efficiency of the output shaft is barely lost, but the vibration damping effect is very poor. Vice versa, when the number of the vibration damping elements is smaller and the vibration damping elements are softer, the vibration damping effect is better. However at this point, the larger the relative movement between the inner housing and the outer housing is, the larger the offset oscillating angle of the output shaft is, and the lower the working efficiency of the oscillating power tool is.

Therefore, in the present technical solution, the head housing vibration damping device 580 comprises two vibration damping elements 558. Those skilled in the art can conceive that the head housing vibration damping device 580 can comprise three to five vibration damping elements 558, which enables the vibration damping effect and the working efficiency of the power tool to be both accepted by the operator, so that the balance between the vibration damping effect and the working efficiency is achieved without obviously increasing the size of the power tool, and operation is more comfortable. Of course, those skilled in the art can conceive that the head housing vibration damping device comprises more than five vibration damping elements.

Particularly, after the output shaft of the oscillating power tool outputs an oscillating angle larger than or equal to 4°, the efficiency is greatly improved, but vibration is also increased greatly. In the present technical solution, the head housing is provided with two to five vibration damping elements, compared with the oscillating power tool without the vibration damping elements, the vibration is reduced greatly, but since the working efficiency will be reduced by disposing the vibration damping elements, the efficiency of the power tool of the present application is reduced to some extent compared with that of the oscillating power tool without the vibration damping elements, but a decreasing degree of the efficiency is lower. That is to say, the oscillating power tool in the present technical solution has good vibration damping effect and better efficiency, and a better operation handfeel and higher working efficiency are obtained.

Referring to the test values of a vibration value in the following table, in a case that other conditions are the same, compared with the oscillating power tool without vibration damping, the vibration value of the oscillating power tool of the present technical solution is reduced by about 50% no matter in a first test position or a second test position.

| | Oscillating power tool without vibration damping | Oscillating power tool adopting present technical solution | Decreasing degree of vibration |
|---|---|---|---|
| First test position | 13.354 | 7.429 | 44.369% |
| Second test position | 21.369 | 10.238 | 52.089% |

Referring to the test values of the working efficiency in the following table, cutting time for cutting the same workpiece is used to reflect cutting efficiency, the values in the following table are the cutting time, and it can be obviously seen that in a case that other conditions are the same, by comparing the oscillating power tool adopting the present technical solution with the oscillating power tool without vibration damping, the cutting time is increased to small extent, the efficiency is reduced to some extent, but the decreasing degree of the efficiency is much lower than that of the vibration value.

| | Oscillating power tool without vibration damping | Oscillating power tool adopting present technical solution | Increasing degree of cutting time |
|---|---|---|---|
| First cutting manner | 5.51 | 5.52 | 0.181% |
| Second cutting manner | 1.61 | 1.85 | 14.907% |

Therefore, the oscillating power tool of the present technical solution has good vibration damping effect and better efficiency, and a better operation handfeel and higher working efficiency are obtained.

Returning to FIG. 17, in the present technical solution, although the two vibration damping elements 558 of the head housing vibration damping device 580 are aligned along the axial direction of the output shaft 522, two longitudinally extending directions Z1 and Z2 of two abutting members 553 abutting against the two vibration damping elements 558 respectively are set at an angle, compared with a case that the Z1 and Z2 are set on one straight line in the same direction, the case that the Z1 and Z2 are set at an angle has the advantage that a space occupied by the two abutting members 553 in an axial direction of the output shaft 522 can be reduced, and the size of the power tool can be reduced. According to the present technical solution, preferably, the two abutting members 553 abutting against the two vibration damping elements 558 are integrally molded and are convenient to machine and mount, compared with a case that the Z1 and Z2 are set in parallel, the case that the Z1 and Z2 are set at an angle has the advantage that an area occupied by the two integrally molded abutting members 553 is smaller, and more cost is saved.

The motor housing vibration damping solution of the present embodiment is same as that of the power tool 300 of the fourth embodiment and is not repeated.

Therefore, in the power tool 500 of the present embodiment, on one side of the middle plane, the head housing vibration damping device 580 comprises two vibration damping elements 558, on the same side of the middle plane, the motor housing vibration damping device 590 comprises one vibration damping element 558, and the three vibration damping elements 558 are triangularly arrayed. Those skilled in the art can conceive that on one side of the middle plane, the vibration damping parts of the head housing vibration damping device 580 and the motor housing vibration damping device 590 form at least one triangle, and the vibration damping part of the head housing vibration damping device 580 forms one side of the triangle. According to the present embodiment, specifically, one side of the triangle comprises two vibration damping elements 558 disposed at intervals. Those skilled in the art can conceive that one side of the triangle comprises one longitudinally extending strip-shaped vibration damping element.

Those skilled in the art can also conceive of disposing a plurality of vibration damping elements on one side of the middle plane, which form more than two different triangles. Of course, preferably, the vibration damping parts of the head housing vibration damping device form one side of the triangle.

The triangle can determine a plane, and the vibration transmitted to the outer housing 544 from the inner housing 542 is limited in this plane, such that the vibration transmitted to the outer housing 544 from the inner housing 542 is reduced to the greatest extent. Besides, the vibration damping part of the head housing vibration damping device forms one side of the triangle, which enables the vibration damping part of the head housing vibration damping device to longitudinally extend, and reduction of the efficiency of the power tool can be avoided.

In the present embodiment, the plane determined by the triangle and the central plane are disposed at an angle, and those skilled in the art can conceive that the plane determined by the triangle and the central plane can also be parallel.

Returning to FIG. 17, in the present embodiment, on one side of the middle plane, a distance L6 between the vibration damping element of the motor housing vibration damping device 590 and the output shaft 522 is larger than or equal to 110 mm. Therefore, the distance between the vibration damping element of the motor housing vibration damping device 590 and the vibration damping element of the head housing vibration damping device 580 is larger. Same as the principle that the larger the distance between the two vibration damping elements on the head housing along the direction of the output shaft 522 is, the higher the working efficiency is, the distance between the vibration damping element of the motor housing vibration damping device 590 and the vibration damping element of the head housing vibration damping device 580 is larger, such that in the axial direction of the motor shaft, an extending length of the vibration damping element along the motor shaft is increased, and the vibration damping elements support both the inner housing 542 and the outer housing 544 in certain range of the axial direction of the motor shaft, and reduction of the working efficiency is avoided.

Those skilled in the art can conceive that on one side of the central plane, the motor housing vibration damping device 590 can also comprise N vibration damping elements (2-5), such that the extending length of the motor housing vibration damping device 590 along the axial direction of the output shaft 522 is larger than that along the radial direction of the output shaft. Of course, those skilled in the art can conceive that the N vibration damping elements can be one longitudinally extending strip-shaped vibration damping element.

A maximal length of the first head housing for receiving part of the output shaft 522 along the direction of the output shaft is L, each of the N vibration damping elements comprises a vibration damping part contacting with the first head housing and the second head housing, a distance between two furthest points of the N vibration damping parts along an axial direction of the output shaft is larger than or equal to 0.2L and smaller than or equal to L. Preferably, the distance between two furthest points of the N vibration damping parts along an axial direction of the output shaft is larger than or equal to 0.4L and smaller than or equal to 0.7L.

Of course, a sum of the lengths of the N vibration damping parts along the axial direction of the output shaft is larger than or equal to 0.2L and smaller than or equal to L. Preferably, the sum of the lengths of the N vibration damping parts along the axial direction of the output shaft is larger than or equal to 0.4L and smaller than or equal to 0.7L.

The maximal length of the vibration damping parts, contacting with the first head housing 593 and the second head housing 597, of the motor housing vibration damping device 590 along the direction of the output shaft is larger than or equal to 15 mm and smaller than or equal to 75 mm. That is, the sum of the lengths of the N vibration damping parts along the axial direction of the output shaft or the distance between the furthest points of the N vibration damping parts along the axial direction of the output shaft is larger than or equal to 15 mm and smaller than or equal to 75 mm, and preferably larger than or equal to 20 mm.

On one side of the middle plane, the motor housing vibration damping device comprises two vibration damping elements, and on the same side of the middle plane, the head housing vibration damping device comprises one vibration damping element, and the three vibration damping elements are in triangularly arrayed. Those skilled in the art can conceive that on one side of the middle plane, the vibration damping elements of the motor housing vibration damping device and the head housing vibration damping device form at least one triangle, and the vibration damping elements of the motor housing vibration damping device form one side of the triangle.

The triangle determines one plane, the plane and the central plane are at an angle, and those skilled in the art can conceive that the plane determined by the triangle and the central plane can be dispose in parallel.

In the present embodiment, the vibration damping element 558 of the head housing vibration damping device 580 is disposed outside the outer profile of the outer housing 544, the vibration damping element 558 of the motor housing vibration damping device 590 is disposed in the inner profile of the inner housing 542, that is, disposed in the internal receiving space of the inner housing 542. Those skilled in the art can conceive that the disposing positions of the vibration damping elements in the first, second, third and fifth embodiments are also suitable for the present embodiment. Besides, no matter the head housing vibration damping device 580 and the motor housing vibration damping device 590, the vibration damping element 558 can be directly disposed in the clearance between the inner housing 542 and the outer housing 544 and can be directly abutted against the inner housing 542 and the outer housing 544.

Seventh Embodiment

Figure 21:
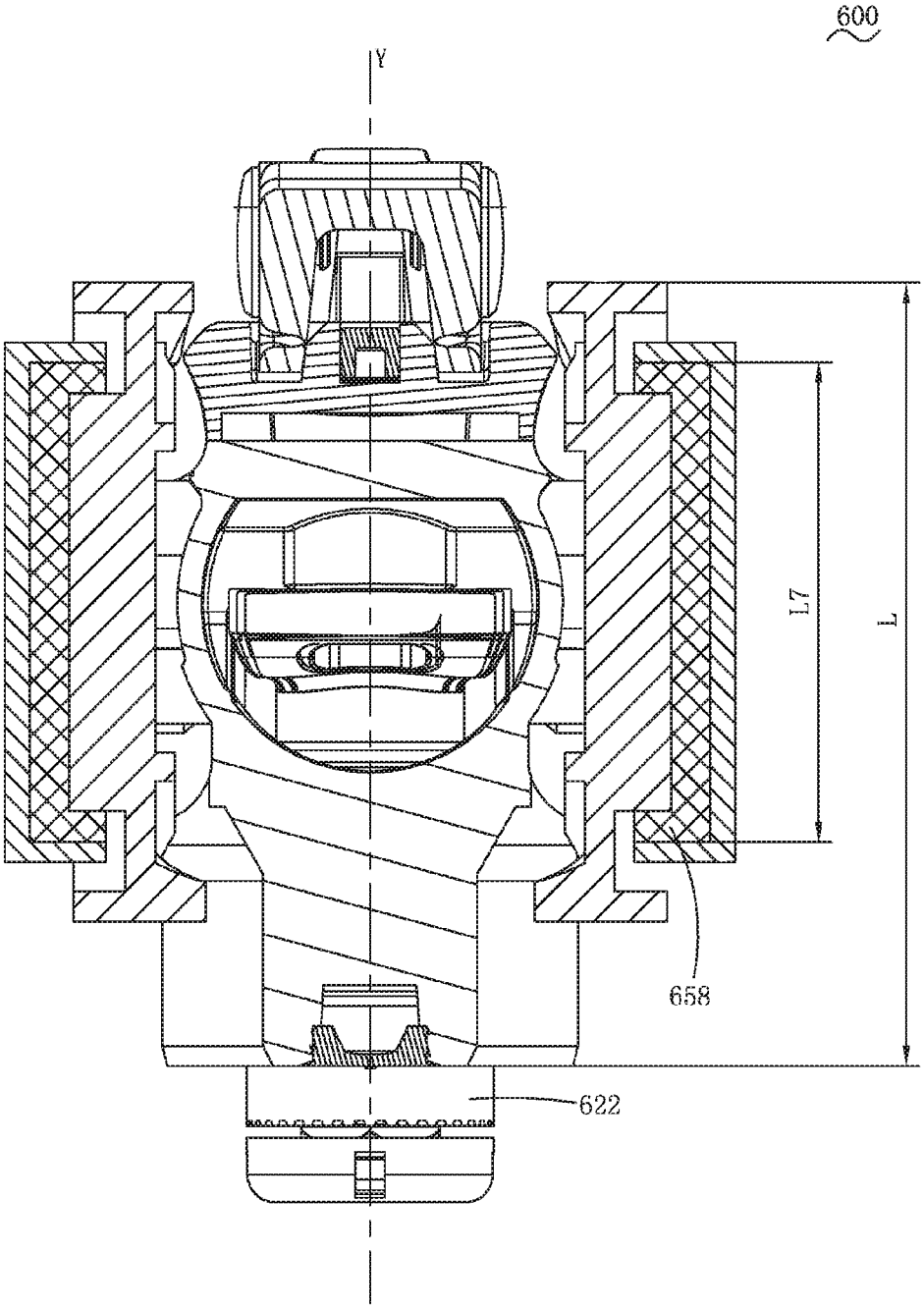
FIG. 21 is a section view of a vibration damping structure of a power tool provided by a seventh embodiment of the present invention.

FIG. 21 shows a power tool 600 provided by a seventh embodiment of the present invention.

The power tool 600 of the present embodiment differs from the power tool 500 of the sixth embodiment in: in the present embodiment, on one side of the middle plane, the head housing vibration damping device only comprises a vibration damping element 658, and the vibration damping element 658 is longitudinally strip-shaped.

In the technical solution mentioned above, the outer profile of a longitudinal section of the vibration damping element is round, in order to achieve a more excellent vibration damping effect, the head housing vibration damping device of the sixth embodiment is provided with the two vibration damping elements to improve the extending length of the whole head housing vibration damping device as well as the extending length of the vibration damping part, contacting with the first head housing and the second head housing, of the whole head housing vibration damping device, and the finally the vibration damping effect is improved. While in the present embodiment, since the vibration damping element 658 is longitudinally strip-shaped per se, its extending length is longer, therefore, on one side of the middle plane, the head housing vibration damping device can comprise one longitudinally strip-shaped vibration damping element 658, of course, under the condition of an allowed space, the head housing vibration damping device can also comprise two to five longitudinally strip-shaped vibration damping elements.

According to the present embodiment, preferably, an extending length of the longitudinally strip-shaped vibration damping element 658 along the axial direction of the output shaft 622 is larger than that along the radial direction of the output shaft. Preferably, a maximal length L7 of the vibration damping part, contacting with the first head housing and the second head housing, of the longitudinally strip-shaped vibration damping element 658 along the direction of the output shaft is larger than or equal to 15 mm and smaller than or equal to 75 mm. Preferably, the maximal length of the first head housing for receiving part of the output shaft 622 along the direction of the output shaft is L, the maximal length L7 of the vibration damping part, contacting with the first head housing and the second head housing, of the longitudinally strip-shaped vibration damping element 658 along the direction of the output shaft is larger than or equal to 0.2L and smaller than or equal to L. Preferably, the maximal length L7 is larger than or equal to 0.4L and smaller than or equal to 0.7L.

Eighth Embodiment

Figure 22:
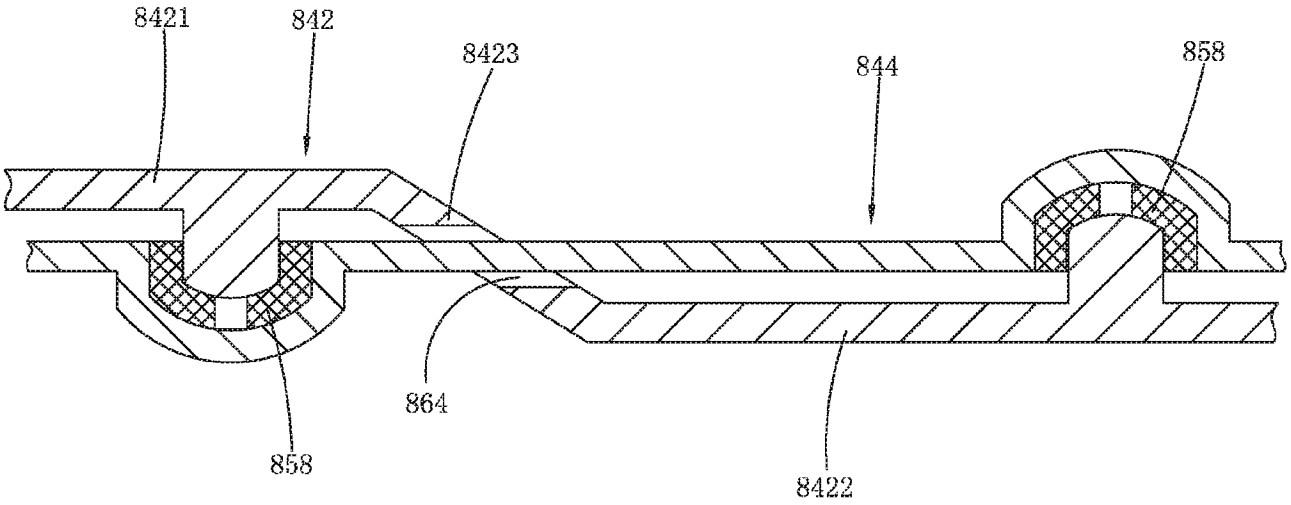
FIG. 22 is a simplified schematic diagram of a vibration damping structure of a power tool provided by an eighth embodiment of the present invention.

FIG. 22 shows a power tool provided by an eighth embodiment of the present invention.

As shown in FIG. 22, the power tool comprises a first housing 842 and a second housing 844 which are separated at intervals, and a vibration damping element 858 is disposed between the first housing 842 and the second housing 844. In the present embodiment, the first housing 842 and the second housing 844 are intercrossed. Specifically, the first housing 842 is approximately step-like and comprises a first part 8421 and a second part 8422 which have a certain height difference and a third part 8423 connected to the first part 8421 and the second part 8422, the third part 8423 is provided with a through hole 864, the second housing 844 approximately longitudinally extends and penetrates through the through hole 8423, and the vibration damping element 858 is disposed both between the second housing 844 and the first part 8421 of the first housing 842 and between the second housing 844 and the second part 8422 of the first housing 842.

In conclusion, in the present invention, the housing is disposed to comprise the first housing and the second housing separated from the first housing by a clearance, and the vibration damping elements are disposed between the first housing and the second housing to prevent the vibration from being directly transmitted to the second housing from the first housing.

There are many specific solutions, for example, an outer diameter of the first housing is smaller than an inner diameter of the second housing, and the vibration damping elements are disposed between the outer profile of the first housing and the inner profile of the second housing.

Or, for example, the first housing has a first side back to the second housing, the first side is provided with a supporting member, the second housing is provided with a connecting unit, having a abutting member facing the first side, and the vibration damping elements are disposed between the supporting member and the abutting member. While the solution that the connecting unit has the abutting member facing the first side is mainly that the connecting unit extends to the first side of the first housing, specifically, the first housing can be provided with a through hole, and the connecting unit penetrates through the through hole to extend to the first side; or the first housing has an end surface, and the connecting unit bypasses the end surface to extend to the first side.

Or, for example, the first housing and the second housing are intercrossed, the vibration damping elements are disposed between the first housing and the second housing which are intercrossed. "The first housing and the second housing are intercrossed" can be that one side of the first housing back to the second housing is provided with a supporting member, the connecting unit disposed on the second housing penetrates through the through hole in the first housing to extend to one side of the first housing back to the second housing, the vibration damping elements are disposed between the supporting member and the connecting unit, at this point, if the supporting member is regarded as part of the first housing and the connecting unit is regarded as part of the second housing, then the first housing and the second housing are separated at intervals and are intercrossed simultaneously; and "the first housing and the second housing are intercrossed" can also be the solution of the eighth embodiment mentioned above and is not repeated.

The power tools of the embodiments above take the oscillating power tool as an example, those skilled in the art can conceive that other power tools such as, a rotational power tool (for example, an electric drill, an angle mill, an electric circular saw, etc.) whose motor drives an output shaft to rotate through a transmission mechanism, a reciprocating power tool (for example a reciprocating saw, a curve saw, etc.) whose motor drives the output shaft to reciprocate through a transmission mechanism, and the like can adopt the vibration damping solution of the present invention. Those skilled in the art can conceive that one power tool can use single vibration damping solutions in different technical solutions mentioned above, and one power tool can also use the combination of two or more technical solutions in different vibration damping solutions mentioned above.

Those skilled in the art can conceive that the present invention can also adopt other implementing manners as long as the adopted technical essence is same as or similar to that of the present invention, or any change and substitution made based on the present invention fall within a protective scope of the present invention.

What is claimed is:

1. A power tool, comprising a housing comprising a first head housing, a second head housing, a first motor housing, and a second motor housing, the first motor housing fixedly connected to the first head housing, the second motor housing fixedly connected to the second head housing;

a motor received in the housing, the motor including a motor shaft, the first motor housing configured to mount the motor; and an output shaft driven by the motor and used for mounting a cutting tool, the first head housing configured to receive a portion of the output shaft, the first head housing having a maximal length L along an axial direction of the output shaft, a plane where an axis of the output shaft is positioned defined as a middle plane, an axis of the motor shaft disposed in parallel with or in the middle plane;

a number N greater than one of vibration damping elements disposed between the first head housing and the second head housing and on at least one side of the middle plane, each vibration damping element comprising a vibration damping part contacting the first head housing and the second head housing, and a sum of lengths of the N vibration damping parts along the axial direction of the output shaft larger than or equal to 0.2L and smaller than or equal to L; and a motor housing vibration damping device disposed between the first motor housing and the second motor housing, the motor housing vibration damping device and the N vibration damping elements defining at least one triangle on one side of the middle plane.

2. The power tool according to claim 1, wherein the sum of the lengths of the N vibration damping parts along the axial direction of the output shaft is larger than or equal to 0.4L and smaller than or equal to 0.7L.

3. The power tool according to claim 1, wherein two vibration damping elements are disposed between the first head housing and the second head housing and on at least one side of the middle plane, and longitudinally extending directions Z1 and Z2 of two abutting members abutting against the two vibration damping elements respectively are set at a non-zero angle with respect to each other.

4. The power tool according to claim 1, wherein the N vibration damping elements form one side of the at least one triangle.

5. The power tool according to claim 4, wherein the one side of the at least one triangle comprises two vibration damping elements spaced apart from each other.

6. The power tool according to claim 4, wherein the one side of the at least one triangle comprises one longitudinally extending strip-shaped vibration damping element.

7. The power tool according to claim 4, wherein a plane that is coplanar with the at least one triangle is parallel to the middle plane.

8. The power tool according to claim 1, wherein the first head housing has a first side facing the second head housing, the first side is provided with a supporting member, the second head housing is provided with a connecting unit, the connecting unit has an abutting member facing the first side and the N vibration damping elements are disposed between the supporting member and the abutting member.

9. The power tool according to claim 1, wherein the second head housing has a first side facing the first head housing, the first side is provided with a supporting member, the first head housing is provided with a connecting unit, the connecting unit has an abutting member facing the first side and the N vibration damping elements are disposed between the supporting member and the abutting member.

10. A power tool, comprising a housing comprising a first head housing, a second head housing, a first motor housing fixedly connected to the first head housing, and a second motor housing fixedly connected to the second head housing;

a motor received in the housing, the motor comprising a motor shaft; and an output shaft driven by the motor and configured to mount a cutting tool, the first head housing configured to receive a portion of the output shaft, a plane where an axis of the output shaft is positioned is defined as a middle plane, an axis of the motor shaft disposed in parallel with or in the middle plane;

a number N that is greater than one of vibration damping elements disposed between the first head housing and the second head housing and on at least one side of the middle plane, each vibration damping element comprising a vibration damping part contacting the first head housing and the second head housing, a distance between two furthest points of the N vibration damping parts along an axial direction of the output shaft larger than a distance between two furthest points along a radial direction of the output shaft; and a motor housing vibration damping device disposed between the first motor housing and the second motor housing, the motor housing vibration damping device and the N vibration damping elements forming at least one triangle on one side of the middle plane.

11. A power tool, comprising a housing comprising a first head housing and a second head housing, the first head housing comprising a first motor housing and a second motor housing;

a motor received in the housing, the motor including a motor shaft, the first motor housing configured to mount the motor;

an output shaft driven by the motor and configured to mount a cutting tool, the first head housing configured to receive a portion of the output shaft, the first head housing having a maximal length L along an axial direction of the output shaft a plane where an axis of the output shaft is positioned is defined as a middle plane, an axis of the motor shaft disposed in parallel with or within the middle plane;

at least two first vibration damping elements disposed between the first motor housing and the second motor housing on at least one side of the middle plane; and a second vibration damping element disposed between the first head housing and the second head housing on the at least one side of the middle plane, the at least two first vibration damping elements and the second vibration damping element defining at least one triangle on the at least one side of the middle plane.

12. The power tool according to claim 11, wherein a plane that is coplanar with the at least one triangle is at a non-zero angle with respect to the middle plane.

13. The power tool according to claim 11, wherein one side of the at least one triangle comprises two of the at least two first vibration damping elements spaced apart from each other.

14. The power tool according to claim 11, wherein a connecting line between central points of the at least two first vibration damping elements is a linear segment, and the linear segment and the axis of the output shaft are parallel or at an angle.

15. The power tool according to claim 11, further comprising at least two second vibration damping elements disposed between the first head housing and the second head housing, the at least two second vibration damping elements including the second vibration damping element, wherein a connecting line between central points of the at least two second vibration damping elements is a linear segment, and the linear segment and the axis of the output shaft are parallel to or at an angle to each other.

16. The power tool according to claim 15, wherein each of the at least two second vibration damping elements comprises one of at least two second vibration damping parts contacting with the first head housing and the second head housing, and a sum of lengths of the at least two second vibration damping parts along the axial direction of the output shaft is larger than or equal to 0.2L and smaller than or equal to L.

17. The power tool according to claim 16, wherein the sum of the lengths of the at least two second vibration damping parts along the axial direction of the output shaft is larger than or equal to 0.4L and smaller than or equal to 0.6L.

18. The power tool according to claim 15, wherein each of the at least two second vibration damping elements comprises one of at least two second vibration damping parts contacting with the first head housing and the second head housing, and a distance between two furthest points of the at least two vibration damping parts along the axial direction of the output shaft is larger than the distance between two furthest points along a radial direction of the output shaft.

* * * * *